US006897000B2

(12) United States Patent
Otani et al.

(10) Patent No.: US 6,897,000 B2
(45) Date of Patent: May 24, 2005

(54) CHARGE CONTROLLING AGENT, METHOD FOR PRODUCING THE SAME AND TONER FOR DEVELOPING ELECTROSTATIC IMAGE

(75) Inventors: Shinji Otani, Ibaraki (JP); Noriyuki Suzuki, Ibaraki (JP); Hideyuki Otsuka, Ibaraki (JP); Mitsutoshi Anzai, Kanagawa (JP)

(73) Assignee: Hodogaya Chemical Co., Ltd., Kawasaki (JP)

( * ) Notice: Subject to any disclaimer, the term of this patent is extended or adjusted under 35 U.S.C. 154(b) by 48 days.

(21) Appl. No.: 10/296,207

(22) PCT Filed: Nov. 6, 2001

(86) PCT No.: PCT/JP01/09676

§ 371 (c)(1),
(2), (4) Date: Nov. 29, 2002

(87) PCT Pub. No.: WO02/37188

PCT Pub. Date: May 10, 2002

(65) Prior Publication Data

US 2003/0162111 A1 Aug. 28, 2003

(30) Foreign Application Priority Data

Nov. 6, 2000 (JP) ..... 2000-337761
Nov. 7, 2000 (JP) ..... 2000-338843

(51) Int. Cl.[7] ..... G03G 9/097

(52) U.S. Cl. ..... 430/108.4; 562/475; 562/476; 562/477; 430/120

(58) Field of Search ..... 430/120, 108.4; 562/475, 476, 477

(56) References Cited

U.S. PATENT DOCUMENTS 3,884,949 A * 5/1975 Eicke et al. ..... 556/44
4,687,869 A * 8/1987 Nachbur ..... 556/132
4,749,638 A * 6/1988 Tsushima et al. ..... 430/108.21
5,204,207 A 4/1993 Yamashita
5,256,514 A * 10/1993 Law et al. ..... 430/108.4
5,451,482 A * 9/1995 Law et al. ..... 430/108.4

FOREIGN PATENT DOCUMENTS

| | | |
|---|---|---|
| EP | 0 432 946 | 6/1991 |
| JP | 61-118761 | 6/1986 |
| JP | 62-163061 | 7/1987 |
| JP | 3-229268 | 10/1991 |
| JP | 5-142867 | 6/1993 |

OTHER PUBLICATIONS

Aldrich Handbook of Fine Chemicals and Laboratory Equipment. (2003) p. 1206, "methyl alcohol".*
DERWENT Abstract 1987–239344 (previously submitted) of JP 62–163061 (Jul. 18, 1987).
DERWENT Abstract 1993–221550 (previously submitted) of JP 5–142867 (Jun. 11, 1993).
DERWENT Abstract 1986–186168 (previously submitted) of JP 61–118761 (Jun. 6, 1986).
DERWENT Abstract 1991–343360 (previously submitted) Of JP 3–229268 (Oct. 11, 1991).

* cited by examiner

*Primary Examiner*—Christopher RoDee
(74) *Attorney, Agent, or Firm*—Oblon, Spivak, McClelland, Maier & Neustadt, P.C.

(57) ABSTRACT

A method for producing a charge controlling agent comprisinig a reaction product of an aromatic hydroxycarboxylic acid and a calcium compound bonded by at least one bondinig system selected from the group consisting of coordinate bonding, covalent bonding and ionic bonding, characterized in that the aromatic hydroxycarboxylic acid and the calcium compound are reacted by dropwise adding a solution of the aromatic hydroxycarboxylic acid to a solution of the calcium compound as a metal-imparting agent, a charge controlling agent produced by said method, which has a shape coefficient (SF-1) average value of at most 250 and a shape coefficient (SF-2) average value of at most 200, and an electrostatic image developing toner containing said charge controlling agent having a presence ratio on a toner surface of at least 2.0 mg/1 g of toner.

12 Claims, 4 Drawing Sheets

CHARGE CONTROLLING AGENT, METHOD FOR PRODUCING THE SAME AND TONER FOR DEVELOPING ELECTROSTATIC IMAGE

TECHNICAL FIELD

The present invention relates to a charge controlling agent, a method for producing the charge controlling agent, a toner for developing an electrostatic image using the charge controlling agent and a developing method using the toner, which are used in an image-forming apparatus used for developing an electrostatic latent image in the field of an electrophotograph, an electrostatic recording material and the like.

BACKGROUND ART

In an image-forming process by electrophotographic system, a visible image is obtained by forming an electrostatic latent image on a photosensitive material comprising an inorganic or organic material, developing the electrostatic latent image with a toner, transferring the developed image onto a paper, a plastic film or the like, and fixing the transferred image thereon. The photosensitive material has a positive chargeability or a negative chargeability depending on its constitution, and when leaving an electrostatic image on a part to be printed by light exposure, development is carried out with a reversely charged toner. On the other hand, when carrying out reverse development by destaticizing a part to be printed, development is carried out with the same side charged toner.

A toner comprises a binding resin, a coloring agent and other additives. A charge controlling agent is generally added in order to provide satisfactory tribo-chargeabilities (including a charging speed, a charging level, a charging stability or the like), a desirable stability as a lapse of time and a satisfactory environmental stability. Properties of the toner are largely influenced by addition of the charge controlling agent.

In case of a color toner, the market of which is expected to become large in future, it is indispensable to use a pale color, preferably colorless charge controlling agent which does not provide an influence on hue. Examples of a conventional charge controlling agent include a metal complex salt compound of a salicylic acid derivative (JP-B-55-42752, JP-A-61-69073, JP-A-61-221756, JP-A-9-124659 and the like), an aromatic dicarboxylic acid metal salt compound (JP-A-57-111541 and the like), a metal complex salt compound of an anthranilic acid derivative (JP-A-62-94856 and the like), and an organic boron compound (U.S. Pat. No. 4,767,688, JP-A-1-306861 and the like).

However, these charge controlling agents have disadvantages that some of them are chromium compounds hardly usable due to more strictly required environmental safety, that some of them are not colorless or do not have a satisfactory pale color required for a color toner, and that some of them are poor in a charge-imparting effect, a chargeability of a toner, or a dispersibility or stability of a compound. JP-A-62-163061 discloses an effective photographic toner containing a calcium salt of 3,5-di-tert-butylsalicylic acid. A charge controlling agent comprising a calcium salt of 3,5-di-tert-butylsalicylic acid disclosed in this publication has a pale color and do not contain a heavy metal such as chromium, and is therefore usable for a color toner. However, although this charge controlling agent is considered not to contain a heavy metal such as chromium, it does not achieve a satisfactory charge-imparting effect demanded nowadays and has a defect of being liable to cause image degradation during long term running. Thus, it is demanded to provide a charge controlling agent having a high charge-imparting effect.

DISCLOSURE OF THE INVENTION

An object of the present invention is to provide ① a colorless or white color charge controlling agent containing no heavy metal and having a high charge-imparting effect, ② a method for producing said charge controlling agent, ③ an electrostatic image developing toner containing said charge controlling agent and having a high charged amount, and ④ a developing method using said toner.

Particularly, the present invention provides a charge controlling agent having a high charge-imparting effect, which comprises calcium and an aromatic hydroxycarboxylic acid bonded to each other by at least one bonding system selected from the group consisting of coordinate bonding, covalent bonding and ionic bonding, and a method for producing the same, and a toner containing said charge controlling agent, and a developing method using said toner.

The present invention capable of achieving the above objects include the following features.

1. A charge controlling agent comprising a reaction product of an aromatic hydroxycarboxylic acid and a calcium compound bonded by at least one bonding system selected from the group consisting of coordinate bonding, covalent bonding and ionic bonding, characterized in that the charge controlling agent has a shape coefficient (SF-1) average value of at most 250 calculated in accordance with the following formula, $$SF\text{-}1=\{(ML^2\times\pi)/4A\}\times 100$$

wherein ML is a maximum length of a particle and A is a projected area of one particle.

2. The charge controlling agent as defined in the above feature 1, characterized in that said charge controlling agent has a shape coefficient (SF-2) average value of at most 200 calculated in accordance with the following formula, $$SF\text{-}2=(PM^2/4A\pi)\times 100$$

wherein PM is a circumference length of a particle and A is a projected area of one particle.

3. The charge controlling agent as defined in the above feature 1 or 2, characterized in that the aromatic hydroxycarboxylic acid is 3,5-di-tert-butylsalicylic acid.

4. A method for producing a charge controlling agent comprising a reaction product of an aromatic hydroxycarboxylic acid and a calcium compound bonded by at least one bonding system selected from the group consisting of coordinate bonding, covalent bonding and ionic bonding, characterized in that the aromatic hydroxycarboxylic acid and the calcium compound are reacted by dropwise adding a solution of the aromatic hydroxycarboxylic acid to a solution of the calcium compound as a metal-imparting agent.

5. The method for producing a charge controlling agent as defined in the above feature 4, characterized in that the reaction product has a shape coefficient (SF-1) average value of at most 250 calculated in accordance with the following formula, $$SF\text{-}1=\{(ML^2\times\pi)/4A\}\times 100$$

wherein ML is a maximum length of a particle and A is a projected area of one particle.

6. The method for producing a charge controlling agent as defined in the above feature 5, characterized in that the reaction product has a shape coefficient (SF-2) average value of at most 200 calculated in accordance with the following formula, $$SF\text{-}2=(PM^2/4A\pi)\times 100$$

wherein PM is a circumference length of a particle and A is a projected area of one particle.

7. The method for producing a charge controlling agent as defined in any one of the above features 4 to 6, characterized in that an aromatic hydroxycarboxylic acid and a calcium compound are reacted at a temperature of from 10 to 70° C. by dropwise adding a solution of the aromatic hydroxycarboxylic acid to a solution of the calcium compound as the metal-imparting agent.

8. The method for producing a charge controlling agent as defined in any one of the above features 4 to 7, characterized in that the aromatic hydroxycarboxylic acid is 3,5-di-tert-butylsalicylic acid.

9. An electrostatic image developing toner which comprises a binding resin, a coloring agent and at least one charge controlling agent selected from a charge controlling agent as defined in any one of the above features 1 to 3 and a charge controlling agent produced by a method for producing a charge controlling agent as defined in any one of the above features 4 to 8.

10. The electrostatic image developing toner as defined in the above feature 9, which comprises the charge controlling agent, a binder resin, a coloring agent, and further a wax and/or a magnetic material.

11. The electrostatic image developing toner as defined in the above feature 9 or 10, characterized in that the charge controlling agent has a presence ratio on a toner surface of at least 2.0 mg/1 g of toner.

12. A one-component developing method, characterized by using an electrostatic image developing toner as defined in any one of the above features 9 to 11.

13. A two-component developing method, characterized by using an electrostatic image developing toner as defined in any one of the above features 9 to 11.

BEST MODE FOR CARRYING OUT THE INVENTION

Figure 1:
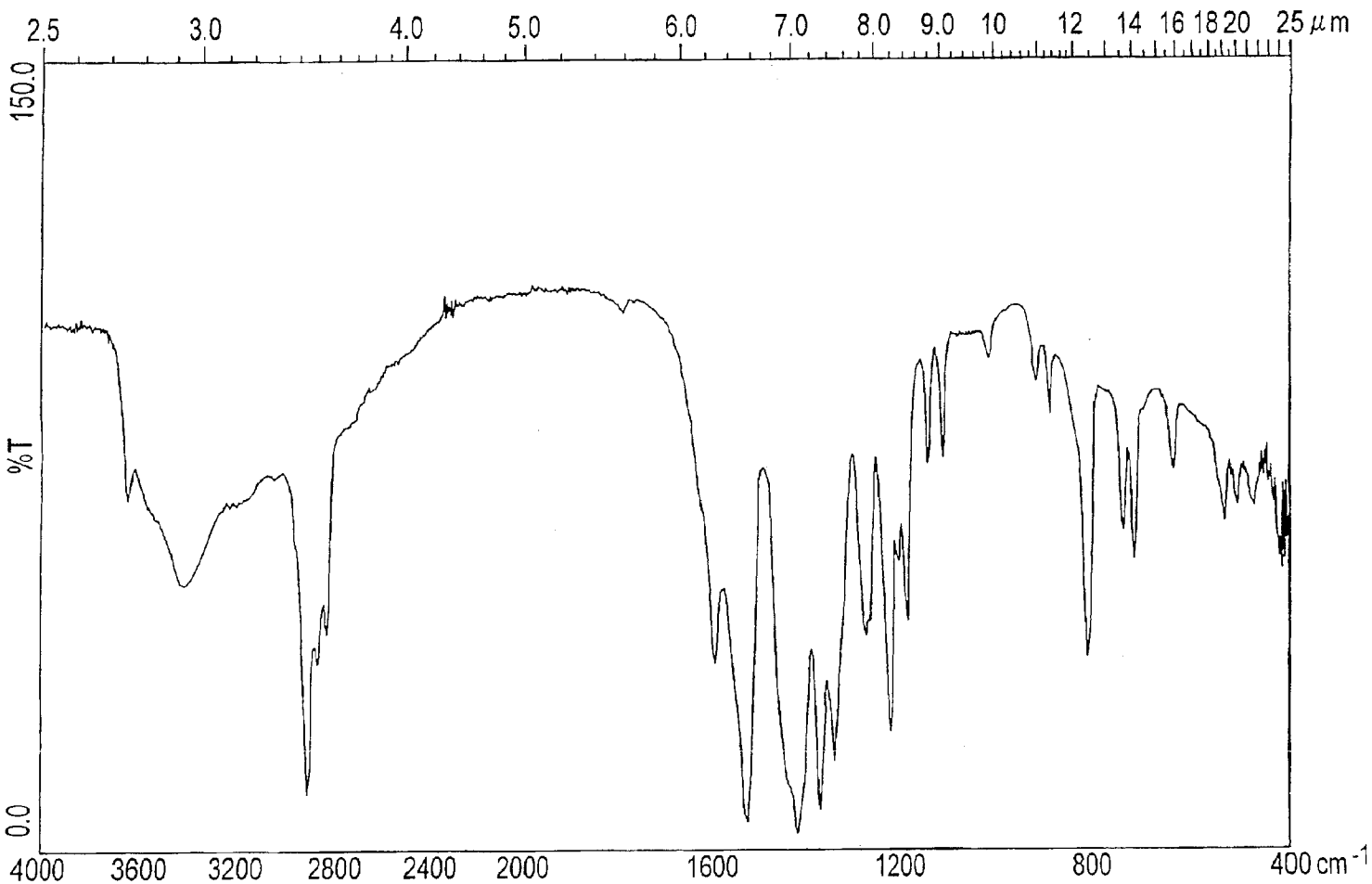
FIG. 1 is an IR chart of the product obtained by Preparation Example 1.

According to the present invention, a method for producing a charge controlling agent comprising a reaction product in which an aromatic hydroxycarboxylic acid and calcium are bonded by at least one bonding system selected from a coordinate bonding, a covalent bonding and an ionic bonding, comprises dropwise adding a solution having the aromatic hydroxycarboxylic acid such as 3,5-di-tert-butylsalicylic acid previously dissolved in an alkali agent such as a sodium hydroxide aqueous solution, onto an aqueous solution of a calcium compound as a metal-imparting agent such as calcium chloride, stirring the resultant mixture at a pH of 6.8 to 13.5 at a temperature of 10 to 70° C. for 1 to 2 hours to react and precipitate, and then subjecting the precipitated reaction product to filtration, washing with water and drying.

An aromatic hydroxycarboxylic acid used in the present invention can be expressed by the formula (1), (2), (3) or (4) as a residue remained after removing a hydroxyl group and a carboxylic acid group from the aromatic hydroxycarboxylic acid, and these aromatic hydroxycarboxylic acids can be used respectively alone or in a mixture of two or more.

(1)

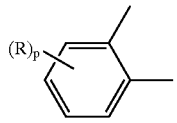

in the above formula (1), R is an alkyl group, an aryl group, an aralkyl group, a cycloalkyl group, an alkenyl group, an alkoxy group, an aryloxy group, a hydroxyl group, an alkoxycarbonyl group, an aryloxy carbonyl group, an acyl group, an acyloxy group, a carboxyl group, a halogen, a nitro group, a cyano group, an amino group, an amide group, a substituted amide group, a carbamoyl group, or a substituted carbamoyl group, and p is an integer of from 0 to 4, and when p is from 2 to 4, R may be the same or different from each other. Also, R may bond to each other to form an aliphatic ring or a hetero ring, and the ring thus formed may further have one or two or more substituents of the above substituent R, and when the ring has two or more substituents, they may be the same or different.

(2)

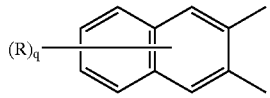

(3)

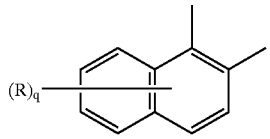

(4)

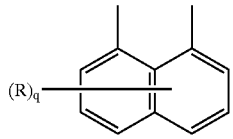

In the above formulae (2), (3) and (4), R is an alkyl group, an aryl group, an aralkyl group, a cycloalkyl group, an alkenyl group, an alkoxy group, an aryloxy group, a hydroxyl group, an alkoxycarbonyl group, an aryloxy carbonyl group, an acyl group, an acyloxy group, a carboxyl group, a halogen, a nitro group, a cyano group, an amino group, an amide group, a substituted amide group, a carbamoyl group, or a substituted carbamoyl group, and q is an integer of from 0 to 6, and when q is from 2 to 6, R may be the same or different from each other. Also, R may bond to each other to form an aliphatic ring or a hetero ring, and the ring thus formed may further have one or two or more substituents of the above substituent R, and when the ring has two or more substituents, they may be the same or different.

Examples of the aromatic hydroxycarboxylic acid expressed by each of the above formulae include salicylic acid having an alkyl group (preferably having a carbon number of from 1 to 9), 3,5-dialkyl(preferably having a carbon number of from 1 to 9)salicylic acid, 2-hydroxy-3-naphthoic acid, alkyl(having a carbon number of from 1 to 9)-2-hydroxynaphthoic acid, 5,6,7,8-tetrahalogen-2-hydroxy-3-naphthoic acid, and the like, but 3,5-di-tert-butylsalicylic acid is particularly preferable since a reaction product obtained from 3,5-di-tert-butylsalicylic acid and a calcium compound is a charge controlling agent providing a high charge-imparting effect.

Examples of the calcium compound used as a metal-imparting agent in the present invention (hereinafter referred to as "calcium-imparting agent") include calcium nitrate, calcium nitrite, calcium carbonate, gypsum, slaked lime, quick lime, calcium hypophosphite, calcium peroxide, calcium powder, calcium chloride and the like, but calcium chloride is preferable.

An amount of an aromatic hydroxycarboxylic acid is preferably in a range of from 1.0 to 2.2 mols, more preferably from 1.9 to 2.0 mols, per mol of calcium of a calcium-imparting agent. If an amount of an aromatic hydroxycarboxylic acid is less than 1.0 mol per mol of a calcium-imparting agent, an amount of a calcium-imparting agent which does not participate in the reaction increases and a byproduct such as calcium hydroxide tends to be produced and to lower a purity. On the other hand, if an amount of an aromatic hydroxycarboxylic acid exceeds 2.2 mols, amounts of an aromatic hydroxycarboxylic acid and a sodium salt of an aromatic hydroxycarboxylic acid increase, and a filtration property is remarkably deteriorated and these impurities provide a bad influence on a charge controlling effect.

An alkali aqueous solution of an aromatic hydroxycarboxylic acid is dropwise added to a calcium aqueous solution having a calcium-imparting agent dissolved in water or the like at a temperature of from 10 to 70° C., preferably from 20 to 40° C. If the temperature is lower than 10° C., a reaction rate is lowered and an unreacted starting material is involved within a crystal, and therefore it becomes difficult to obtain a charge controlling agent having a desired charging performance. If the temperature exceeds 70° C., a shape of the crystal particle obtained becomes column-like or needle-like, and thus, a shape coefficient (SF-1) tends to exceed 250 and it becomes difficult to obtain a charge controlling agent having a desired charging performance.

Examples of an alkali agent for dissolving an aromatic hydroxycarboxylic acid include sodium hydroxide, potassium hydroxide, sodium methoxide, sodium ethoxide and the like, but sodium hydroxide or potassium hydroxide is preferable as an alkali agent for dissolving 3,5-di-tert-butylsalicylic acid which is the most preferable starting material in the present invention.

A reaction product of an aromatic hydroxycarboxylic acid and a calcium compound obtained in accordance with the production method of the present invention, which has at least one bonding system selected from a coordinate bond, a covalent bond and an ionic bond between calcium. and an aromatic hydroxycarboxylic acid, contains a calcium complex, a calcium complex salt and a calcium salt or their mixture.

The calcium salt, the calcium complex and the calcium complex salt are expressed respectively by the following formulae (5), (6) and (7), and include compounds having these structures.

(5)

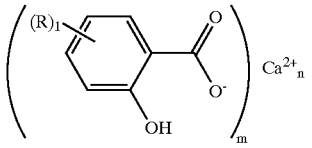

(6)

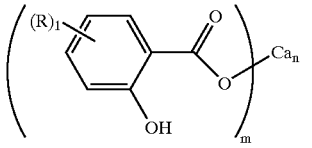

In the above formulae (5) and (6), R is an alkyl group, an aryl group, an aralkyl group, a cycloalkyl group, an alkenyl group, an alkoxy group, an aryloxy group, a hydroxyl group, an alkoxycarbonyl group, an aryloxy carbonyl group, an acyl group, an acyloxy group, a carboxyl group, a halogen, a nitro group, a cyano group, an amino group, an amide group, a substituted amide group, a carbamoyl group, or a substituted carbamoyl group, and 1 is an integer of from 0 to 4, m is an integer of from 1 to 8 and n is an integer of from 1 to 4. When 1 is an integer of from 2 to 4, R may be the same or different from each other. Also, R may bond to each other to form an aliphatic ring, an aromatic ring or a hetero ring, and the ring thus formed may further have one or two or more substituents of the above substituent R, and when m is at least 2 in these compounds, an aromatic hydroxycarboxylic acid as a ligand may be the same or different, and these compounds may be a mixture having different numbers of m and/or n, and a hydroxyl group on the aromatic ring may coordinate-bonded with a calcium metal to form a chelate compound, and the hydroxyl group may not participate in bonding. Further, these compounds may have a coordinated water of at least one molecule.

(7)

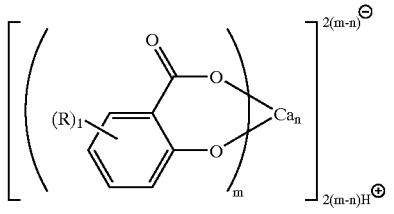

In the above formula (7), R is an alkyl group, an aryl group, an aralkyl group, a cycloalkyl group, an alkenyl group, an alkoxy group, an aryloxy group, a hydroxyl group, an acyloxy group, an alkoxycarbonyl group, an aryloxy carbonyl group, an acyl group, a carboxyl group, a halogen, a nitro group, a cyano group, an amino group, an amide group, a substituted amide group, a carbamoyl group, or a substituted carbamoyl group, and l is an integer of from 0 to 4, and m is an integer of from 1 to 8, and n is an integer of from 1 to 4. When l is from 2 to 4, R may be the same or different. Also, R may bond to each other to form an aliphatic ring, an aromatic ring or a hetero ring, and the ring thus formed may further have one or two or more substituents of the above substituent R. Also, when m is at least 2 in these compounds, an aromatic hydroxycarboxylic acid as a ligand may be the same or different, and these compounds may be a mixture having different numbers of m and/or n. Further, these compounds may have a coordinated water of at least one molecule.

A shape coefficient (SF-1) of a charge controlling agent used in the present invention is a value of numbers calculated in accordance with the following formula, and SF-1 expresses a strain of a particle, and if a particle becomes closer to a sphere (a projected image is a complete round), an SF-1 value becomes closer to 100, and if this value becomes larger, a particle becomes longer and narrower.

$$SF\text{-}1=\{(ML^2\times\pi)/4A\}\times 100$$

(In the above formula, ML is a maximum length of a particle and A is a projected area of one particle.)

A shape coefficient (SF-2) of a charge controlling agent used in the present invention is a value of numbers calculated in accordance with the following formula. The shape coefficient (SF-2) expresses an irregularity degree of a particle surface, and if a particle becomes closer to a sphere (a projected image of a particle is a complete round), an SF-2 value becomes closer to 100.

$$SF\text{-}2=(PM^2/4A\pi)\times 100$$

(In the above formula, PM is a circumference length of a particle and A is a projected area of one particle.)

In the above shape coefficient (SF-1) and shape coefficient (SF-2), maximum length ML of particle, projected area A of particle and circumference length PM of particle are obtained by sampling a group of about 30 product particles as an image enlarged 1,000 times in one view by an optical microscope (such as BH-2, manufactured by Olympus Optical Co., Ltd.) equipped with a CCD camera, transferring obtained images to an image analyzing apparatus (such as Luzex FS® manufactured by Nireko K.K.), measuring a maximum length of an image of one particle (maximum length ML of particle), an area of an image of one particle (projected area A of particle) and a circumference length of an image of one particle (circumference length PM of particle), and substituting the measured values of each particle for the above calculation formulae to obtain an average value. The above measurement operation is repeated until measuring about 3,000 particles of one product, and shape coefficients SF-1 and SF-2 of each charge controlling agent are expressed by average values of measured values of all particles.

A shape coefficient (SF-1) of a charge controlling agent of the present invention should preferably be at most 250. If a toner is prepared by using a charge controlling agent of the present invention having a shape coefficient (SF-1) of at most 250, a toner having a high charged amount can be obtained. If a toner is prepared by using a charge controlling agent having a shape coefficient (SF-1) exceeding 250, a charge controlling effect becomes poor and an image is degraded due to occurrence of fogging or lowering of resolving power in image formation during long term running. Also, a shape coefficient (SF-2) should preferably be at most 200. If the shape coefficient (SF-2) exceeds 200, a charge controlling effect becomes poor and an image is remarkably degraded due to occurrence of fogging or lowering of resolving power in image formation during long term running.

A method of producing a charge controlling agent in accordance with the present invention comprises dropwise adding an alkali aqueous solution of an aromatic hydroxycarboxylic acid to an aqueous solution of a calcium-imparting agent such as calcium chloride, and reacting the resultant reaction solution preferably at a pH of from 6.8 to 13.5 at a temperature of from 10 to 70° C. By employing this reaction method, a crystal compound having a shape coefficient (SF-1) of at most 250, i.e. having a shape close to a sphere, can be obtained. On the other hand, according to such a method as disclosed in JP-A-62-163061, which comprises dropwise adding a calcium chloride aqueous solution as a calcium-imparting agent to an alkali aqueous solution of an aromatic hydroxycarboxylic acid, only a crystal product having a shape coefficient (SF-1) exceeding 250, i.e. having a rod-like or needle-like shape, is obtained, and a reaction product of a calcium compound comprising such a crystal as having a shape coefficient (SF-1) exceeding 250 achieves only a low charge-imparting effect and does not provide a satisfactory charge controlling agent.

In the present invention, it is preferable to adjust a volume average particle size of a charge control agent within a range of from 0.1 to 20 μm, preferably from 1 to 10 μm.

If the volume average particle size is less than 0.1 μm, the amount of the charge control agent appearing on the surface of a toner becomes very small, and the aimed effect of the charge control agent can not be achieved. On the other hand, if the volume average particle size is larger than 20 μm, an amount of a charge control agent dropped from a toner is increased, and a bad influence of polluting a copying machine is caused.

In the present invention, it is preferable to add a charge control agent in an amount of from 0.1 to 10 parts by mass, more preferably from 0.2 to 5 parts by mass, per 100 parts by mass of a binder resin.

The charge control agent of the present invention may be used not only in a one-component developing system toner but also in a two-component developing system toner, and also may be used in a capsule toner and a polymer toner, and further may be used in a magnetic toner or a non-magnetic toner.

The electrostatic image developing toner of the present invention can be prepared in accordance with a well known conventional method. Examples of the preparation method include a method (pulverizing method) comprising melting a mixture of a binder resin, a charge control agent, a coloring agent and the like in a heat-mixing apparatus, kneading, pulverizing and classifying, a method comprising dissolving the above mixture, spraying to produce fine particles, drying and classifying, and a polymerization method comprising dispersing a coloring agent and a charge control agent in suspended monomer particles, and other methods.

The preparation method by the pulverizing method is described in more details hereinafter. A binder resin is uniformly mixed with a coloring agent, a charge control agent, a wax, and other additives. The mixing can be carried out by a well-known stirrer such as a Henschel mixer, a super mixer, a ball mill or the like. The mixture thus obtained is heat-melted and kneaded by a sealing type kneader or a mono-axial or two-axial extruder. The kneaded product is cooled, and is roughly pulverized by a crusher or a hammer mill, and further finely divided by a pulverizing machine such as a jet mill or a high-speed rotary type mill. The pulverized product is further-treated by a air classifier such as a inertia type Elbowjet using a coanda effect, a cyclone (centrifugal) classification type Microplex, a DS separator and the like, to be classified into a predetermined particle size. Further, when a surface of a toner is treated by additives, the toner and additives are stirred and mixed by a high-speed stirrer such as a Henschel mixer, super mixer and the like.

Also, the toner of the present invention can be prepared by a suspension polymerization method. In the suspension polymerization method, a polymerizable monomer, a coloring agent, a polymerization initiator, a charge control agent, and optionally a crosslinking agent, and other additives are uniformly dissolved or dispersed to prepare a monomer composition, and the monomer composition is converted into a continuous phase containing a dispersion stabilizer, for example, by dispersing into an aqueous phase by an appropriate stirrer and a dispersing machine, such as a homomixer, a homogenizer, an atomizer, a microfluidizer, a one liquid fluid nozzle, a gas-liquid fluid nozzle, or an electric emulsifying machine. At the same time, a polymerization reaction is carried out to obtain toner particles having a desired particle size. The particles thus obtained can be treated with additives in accordance with the above-mentioned method.

The toner of the present invention can be prepared also by an emulsion polymerization method. As compared with the particles obtained by the above-mentioned suspension polymerization method, the emulsion polymerization method provides particles excellent in uniformity, but since the particles obtained by the emulsion polymerization method have a very small average particle size of from 0.1 to 1.0 $\mu$m, the emulsified particles may be used as nuclei and a polymerizable monomer may be added thereto to grow particles. That is, a seed polymerization method or a method of joining or melting emulsified particles to produce particles having an appropriate average particle size may be carried out.

According to these polymerization methods, it is not necessary to impart brittleness to toner particles since a pulverizing step is not employed, and it is possible to employ a large amount of a low softening point material which has been hardly used in a conventional pulverizing method, thus enabling a wide choice of a material to be used. Further, a coloring agent or a release agent which is a hydrophobic material is hardly exposed on the surface of toner particles, and it is therefore possible to reduce pollution of a toner-carrying member, a photosensitive material, a transfer roller and a fixer.

When the toner of the present invention is prepared by the above polymerization method, a faithful image productivity, a release property, a color reproductivity and other properties can be further improved, and in order to make responsive to minute dots, a toner particle size can be minimized, and a toner of minute particle size having a sharp particle size distribution can be relatively easily produced.

Hereinafter, concrete materials to be used for preparing an electrostatic image developing toner of the present invention are illustrated below.

The electrostatic image developing toner of the present invention basically comprises a binder resin, a coloring agent (such as a pigment, a dye and the like) and a charge control agent, and may further contain a release agent (such as wax), other additives (such as a cleaning-improving agent, a fluidity-improving agent and the like), and a magnetic material.

As a binder resin, any of well known materials may be used, examples of which include a polymer having a vinyl polymer unit such as a styrene type monomer, an acryl type monomer, a methacryl type monomer or the like, and a copolymer of at least two kinds of these monomers, a polyester type polymer, a polycarbonate resin, a polyol resin, a phenolic resin, a silicone resin, a polyurethane resin, a polyamide resin, a furan resin, an epoxy resin, a xylene resin, a terpene resin, a coumarone-indene resin, a petroleum resin, and the like.

Examples of a vinyl type monomer constituting a vinyl type polymer unit include styrene and its derivatives such as styrene, o-methylstyrene, m-methylstyrene, p-methylstyrene, p-phenylstyrene, p-ethylstyrene, 2,4-dimethylstyrene, p-n-atylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene, p-nitrostyrene and the like;

monoolefins such as ethylene, propylene, butylene, isobutylene and the like;

polyenes such as butadiene, isoprene and the like;

vinyl halides such as vinyl chloride, vinylidene chloride, vinyl bromide, vinyl fluoride, and the like;

vinyl esters such as vinyl acetate, vinyl propionate, vinyl benzoate, and the like;

$\alpha$-methylene aliphatic monocarboxylic acid esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, diethylaminoethyl methacrylate, and the like;

acrylic acid esters such as methyl acrylate, ethyl acrylate, propyl acrylate, n-butyl acrylate, isobutyl acrylate, n-octyl acrylate, dodecyl acrylate, 2-ethylhexyl acrylate, stearyl acrylate, 2-chloroethyl acrylate, phenyl acrylate, and the like;

vinyl ethers such as vinyl methyl ether, vinyl ethyl ether, vinyl isobutyl ether, and the like;

vinyl ketones such as vinyl methyl ketone, vinyl hexyl ketone, methyl isopropenyl ketone, and the like;

N-vinyl compounds such as N-vinyl pyrrhol, N-vinyl carbazole, N-vinyl indole, N-vinyl pyrrolidone, and the like;

vinyl naphthalenes; and acrylic acid or methacrylic acid derivatives such as acrylonitrile, methacrylonitrile, acrylamide, and the like.

Further examples include an unsaturated dibasic acid such as maleic acid, citraconic acid, itaconic acid, alkenyl succinic acid, fumaric acid and mesaconic acid;

an unsaturated dibasic anhydride such as maleic anhydride, citraconic anhydride, itaconic anhydride and alkenylsuccinic anhydride;

an unsaturated dibasic acid half ester such as methyl maleate half ester, ethyl maleate half ester, butyl maleate half ester, methyl citraconate half ester, ethyl citraconate half ester, butyl citraconate half ester, methyl itaconate half ester, methyl alkenyl-succinate half ester, methyl fumarate half ester and methyl mesaconate half ester;

an unsaturated dibasic acid ester such as dimethyl maleate and dimethyl fumarate;

an $\alpha,\beta$-unsaturated acid such as acrylic acid, methacrylic acid, crotonic acid and cinnamic acid;

an $\alpha,\beta$-unsaturated acid anhydride such as crotonic anhydride and cinnamic anhydride; an anhydride of lower aliphatic acid and $\alpha,\beta$-unsaturated acid; and a carboxyl group-containing monomer such as an alkenylmalonic acid, an alkenylglutaric acid, an alkenyladipic acid, and their acid anhydrides and their monoesters.

Still further examples include acrylic or methacrylic acid esters such as 2-hydroxyethyl acrylate, 2-hydroxyethyl methacrylate and 2-hydroxypropyl methacrylate; and a hydroxy group-containing monomer such as 4-(1-hydroxy-1-methylbutyl)styrene and 4-(1-hydroxy-1-methylhexyl) styrene.

In the electrostatic image developing toner of the present invention, a vinyl type polymer unit of a binder resin may have a crosslinking structure crosslinked by a crosslinking agent having at least 2 vinyl groups, and examples of the crosslinking agent used therein include an aromatic divinyl compound such as divinyl benzene and divinyl naphthalene;

and diacrylate compounds bonded with alkyl chains such as ethylene glycol diacrylate, 1,3-butylene glycol diacrylate, 1,4-butane diol diacrylate, 1,5-pentane diol diacrylate, 1,6-hexane diol diacrylate and neopentyl glycol diacrylate, and dimethacrylate derivatives of these compounds in which acrylate is replaced by methacrylate.

Further examples include diacrylate compounds bonded with alkyl chains containing ether bonds such as diethylene glycol diacrylate, triethylene glycol diacrylate, tetraethylene glycol diacrylate, polyethylene glycol #400 diacrylate, polyethylene glycol #600 diacrylate and dipropylene glycol diacrylate, and dimethacrylate derivatives of these compounds in which acrylate is replaced by methacrylate.

Still further examples include diacrylate compounds bonded with chains containing ether bonds and aromatic groups, such as polyoxyethylene(2)-2,2-bis(4-hydroxyphenyl)propane diacrylate, polyoxyethylene(4)-2,2-bis(4-hydroxyphenyl)propane diacrylate, and dimethacrylate derivatives of these compounds in which acrylate is replaced by methacrylate. Examples of polyester type diacrylates include trade name MANDA (manufactured by Nihon Kayaku K.K.), and the like.

Examples of a polyfunctional crosslinking agent include pentaerythritol triacrylate, trimethylolethane triacrylate, trimethylolpropane triacrylate, tetramethylolmethane tetraacrylate, oligoester acrylate, and their derivatives in which acrylate is replaced by methacrylate, triaryl cyanurate, triaryl trimellitate, and the like.

These crosslinking agents are used in an amount of from 0.01 to 10 parts by mass, preferably from 0.03 to 5 parts by mass, per 100 parts by mass of other monomer component.

Among these crosslinking monomers, an aromatic divinyl compound (particularly divinyl benzene) and a diacrylate compound bonded with a chain containing one ether bond and an aromatic group are preferable in view of fixing property and offset resistance of a toner resin.

Examples of a polymerization initiator used in the preparation of a vinyl type copolymer of the present invention include 2,2'-azobisisobutylonitrile, 2,2'-azobis(4-methoxy-2,4-dimethylvaleronitrile), 2,2'-azobis(-2,4-dimethylvaleronitrile), 2,2'-azobis(-2-methylbutylonitrile), dimethyl-2,2'-azobisisobutyrate, 1,1'-azobis(1-cyclohexanecarbonitrile), 2-(carbamoylazo)-isobutylonitrile, 2,2'-azobis(2,4,4,-trimethylpentane), 2-phenylazo-2,4-dimethyl-4-methoxyvaleronitrile, 2,2'-azobis(2-methyl-propane);

methyl ethyl ketone peroxide, acetylacetone peroxide, cyclohexanone peroxide and other ketone peroxides, 2,2-bis(t-butylperoxy)butane, t-butyl hydroperoxide, cumene hydroperoxide, 1,1,3,3-tetramethylbutyl hydroperoxide, di-t-butyl peroxide, t-butylcumyl peroxide, dicumyl peroxide, α'-bis(t-butylperoxyisopropyl)benzene, isobutyl peroxide, octanoyl peroxide, decanoyl peroxide, lauroyl peroxide, 3,5,5-trimethylhexanoyl peroxide, benzoyl peroxide, m-triole peroxide, di-isopropyl peroxydicarbonate, di-2-ethylhexyl peroxydicarbonate, di-n-propyl peroxydicarbonate, di-2-ethoxyethyl peroxycarbonate, di-ethoxyisopropyl peroxydicarbonate, di(3-methyl-3-methoxybutyl) peroxycarbonate, acetylcyclohexylsulfonyl peroxide, t-butyl peroxyacetate, t-butylperoxyisobutylate, t-butylperoxy-2-ethylhexalate, t-butylperoxylaurate, t-butyl-oxybenzoate, t-butylperoxyisopropylcarbonate, di-t-butylperoxyisophthalate, t-butylperoxyarylcarbonate, isoamylperoxy-2-ethylhexanoate, di-t-butylperoxyhexahydroterephthalate, t-butylperoxyazelate, and the like.

A vinyl type polymer has preferably a glass transition temperature of from 40 to 90° C., a number average molecular weight (Nm) of from 1,500 to 50,000 and a weight average molecular weight (Mw) of from 10,000 to 5,000,000, more preferably a glass transition temperature of from 45 to 85° C., a number average molecular weight of from 2,000 to 20,000 and a weight average molecular weight of from 15,000 to 3,000,000.

The vinyl type polymer has preferably an OH value of at most 50 mg KOH/g, more preferably an OH value of at most 30 mg KOH/g.

Examples of a monomer constituting a polyester type polymer include a dihydric alcohol component such as ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, or an ether compound of bisphenol A with ethylene glycol or propylene glycol, and the like.

It is preferable also to use a trihydric or higher hydric alcohol in order to crosslink a polyester resin. Examples of the trihydric or higher hydric alcohol include sorbitol, 1,2,3,6-hexanetetrol, 1,4-sorbitan, pentaerythritol, dipentaerythritol, tripentaerythritol, 1,2,4-butanetriol, 1,2,5-pentatriol, glycerol, 2-methylpropanetriol, 2-methyl-1,2,4-butanetriol, trimethylolethane, trimethylolpropane, 1,3,5-trihydroxybenzene, and the like.

Examples of an acid component include benzene dicarboxylic acids such as phthalic acid, isophthalic acid and terephthalic acid or their anhydrides or their lower alkyl esters; alkyl dicarboxylic acids such as succinic acid, adipic acid, sebacic acid and azelaic acid or their anhydrides; unsaturated dibasic acids such as maleic acid, citraconic acid, itaconic acid, alkenyl succinic acid, fumaric acid and mesaconic acid; and unsaturated dibasic acid anhydrides such as maleic anhydride, citraconic anhydride, itaconic anhydride and an alkenyl succinic anhydride. Also, examples of a trivalent or higher polycarboxylic acid component include trimellitic acid, pyromellitic acid, 1,2,4-benzenetricarboxylic acid, 1,2,5-benzenetricarboxylic acid, 2,5,7-nephthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl)methane, 1,2,7,8-octanetetracarboxylic acid and embole trimer acid, and their anhyrides, and their lower alkyl esters.

A polyester resin obtained after polymerization has preferably a glass transition point of from 40 to 90° C., a number average molecular weight (Nm) of from 1,500 to 50,000 and a weight average molecular weight (Mw) of from 10,000 to 5,000,000, more preferably a glass transition point of from 45 to 85° C., a number average molecular weight of from 2,000 to 20,000 and a weight average molecular weight of from 15,000 to 3,000,000.

Also, the resin has preferably an OH value of at most 50 mg KOH/g, more preferably at most 30 mg KOH/g.

In the present invention, a vinyl type copolymer component and/or a polyester resin component preferably contain a monomer component reactive with the both resin components. Among monomers constituting the polyester resin component, examples of a monomer reactive with the vinyl type copolymer include an unsaturated dicarboxylic acid such as phthalic acid, maleic acid, citraconic acid and itaconic acid, or their anhydrides. Examples of a monomer constituting the vinyl type copolymer component include a material having a carboxyl group or a hydroxyl group, acrylic acid or methacrylic acid esters, and the like.

A binder resin such as the polyester type polymer or the vinyl type polymer has preferably an acid value of from 0.1 to 50 mg KOH/g, more preferably an acid value of from 0.1 to 45 mg KOH/g.

Also, a mixture of at least two kinds of different binder resins may be used, and in such a case, the mixture preferably contains a resin having an acid value of from 0.1 to 50 mg KOH/g in an amount of at least 60 mass %.

As a coloring agent, a black toner contains generally a black or blue dye or pigment particles for a two-component-developer and a non-magnetic one-component developer, and contains various magnetic materials for a magnetic one-component developer.

Examples of the black or blue pigment include carbon black, aniline black, acetylene black, phthalocyanine blue, indanthrene blue, and the like.

Examples of the black or blue dye include an azo type dye, an anthraquinone type dye, a xanthene type dye, a methine type dye, and the like.

In any case, the coloring agent is used in an amount necessary to maintain a desired optical reflective density of an image after fixing, and is used in an amount of from 0.1 to 20 parts by mass, preferably from 2 to 12 parts by mass, per 100 parts by mass of a resin.

Examples of a material used as a magnetic material for coloring purpose include a metal fine powder of iron, nickel, cobalt or the like, an alloy of a metal such as iron, lead, magnesium, antimony, beryllium, bismuth, cadmium, calcium, manganese, selenium, titanium, tungsten, vanadium, cobalt, copper, aluminum, nickel, zinc or the like, a metal oxide such as aluminum oxide, iron oxide, titanium oxide or the like, a ferrite of iron, manganese, nickel, cobalt, zinc or the like, a nitride such as vanadium nitride, chromium nitride or the like, a carbide such as tungsten carbide, silicone carbide or the like, and their mixtures. As a magnetic material, an iron oxide such as magnetite, hematite or ferrite is preferable. These magnetic materials have a large influence on the chargeability of a toner, but a charge control agent of the present invention provides a satisfactory charging performance regardless of these magnetic materials.

The toner of the present invention may further contain a different other charge control agent to further stabilize the chargeability, if necessary, and the total amount of charge control agents is preferably from 0.1 to 10 parts by mass, more preferably from 0.2 to 5 parts by mass, per 100 parts by mass of a binder resin.

Examples of the different other charge control agents include an organic metal complex, a chelate compound, an organic metal salt or the like as a charge control agent for negative chargeability, more concrete examples of which include a monoazometal complex, a metal complex or a metal salt of an aromatic hydroxycarboxylic acid, an aromatic dicarboxylic acid compound or the like, and further an aromatic hydroxycarboxylic acid, an aromatic mono- and polycarboxylic acid, their anhydride, and their esters, and phenol derivatives of bisphenol, and the like. Also, in order to improve stability, the toner may further contain a charge control agent for positive chargeability in combination, examples of which include a nigrosine dye, an azine dye, a triphenylmethane type dye, a quaternary ammonium salt, a resin having a quaternary ammonium salt in a side chain, and the like.

When the toner of the present invention is used as a magnetic toner, examples of a magnetic material to be contained in the magnetic toner include an iron oxide such as magnetite, hematite or ferrite, and an iron oxide containing other metal oxides; a metal such as Fe, Co or Ni, or alloys of these metals with a metal such as Al, Co, Cu, Pb, Mg, Ni, Sn, Zn, Sb, Be, Bi, Cd, Ca, Nm, Se, Ti, W or V, and their mixtures.

More concrete examples of the magnetic material include triiron tetroxide ($Fe_3O_4$), diiron trioxide ($\gamma$-$Fe_2O_3$), zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O$), nickel iron oxide ($NiFe_2O_4$), neodymium iron oxide ($NdFe_2O$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), iron powder (Fe), cobalt powder (Co), nickel powder (Ni), and the like. The above magnetic materials may be used alone or in a mixture of two or more. Particularly preferable magnetic materials are fine powders of triiron tetroxide or $\gamma$-diiron trioxide.

These ferromagnetic materials have an average particle size of from 0.1 to 2 $\mu$m (preferably from 0.1 to 0.5 $\mu$m), and preferably have magnetic properties under application of 10K oersted of a coercive force of from 20 to 150 oersted, a saturation magnetization of from 50 to 200 emu/g (preferably from 50 to 100 emu/g) and a residual magnetization of from 2 to 20 emu/g.

The magnetic materials are used in an amount of from 10 to 200 parts by mass, preferably from 20 to 150 parts by mass, per 100 parts by mass of a binder resin.

In addition to a magnetic material, a magnetic toner may further contain a coloring agent such as carbon black, titan white, or other pigments and/or dyes. For example, when the toner of the present invention is used as a magnetic color toner, examples of a dye to be used include C.I. Direct Red 1, C.I. Direct Red 4, C.I. Acid Red 1, C.I. Basic Red 1, C.I. Mordant Red 30, C.I. Direct Blue 1, C.I. Direct Blue 2, C.I. Acid Blue 9, C.I. Acid Blue 15, C.I. Basic Blue 3, C.I. Basic Blue 5, C.I. Mordant Blue 7, C.I. Direct Green 6, C.I. Basic Green 4, C.I. Basic Green 6, and the like.

Examples of a pigment to be used include Mineral Fast Yellow, Naple Yellow, Naphthol Yellow S, Hansa Yellow G, Permanent Yellow NCG, Tert Razin Lake, Molybdenum Orange, Permanent Orange GTR, Pyrazolone Orange, Benzidine Orange G, Cadmium Red, Permanent Red 4R, Watching Red Calcium Salt, Eosine Lake, Brilliant Carmine 3B, Manganese Violet, Fast Violet B, Methylviolet Lake, Cobalt Blue, Alkali Blue Lake, Victoria Blue Lake, Phthalocyanine Blue, First Sky Blue, Indanthrene Blue BC, Pigment Green B, Malachite Green Lake, Final Yellow Green G, and the like.

When the toner of the present invention is used as a non-magnetic toner for two-component full color, the following coloring agents may be used.

Examples of a magenta-coloring pigment include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207 and 209, C.I. Pigment Violet 19, C.I. Bat Red 1, 2, 10, 13, 15, 23, 29 and 35, and the like.

The above pigments may be used alone, but it is preferable to use them in combination with a dye to improve a clarity in view of an image quality of full color image.

Examples of a magenta dye to be used include an oil-soluble dye such as C.I. Solvent Red 1, 3, 8, 23, 24, 25, 27, 30, 49, 81, 82, 83, 84, 100, 109 and 121, C.I. Disperse Red 9, C.I. Solvent Violet 8, 13, 14, 21 and 27, C.I. Disperse Violet 1, and the like, a basic dye such as C.I. Basic Red 1, 2, 9, 12, 13, 14, 15, 17, 18, 22, 23, 24, 27, 29, 32, 34, 35, 36, 37, 38, 39 and 40, C.I Basic Violet 1, 3, 7, 10, 14, 15, 21, 25, 26, 27 and 28, and the like.

Examples of a cyan coloring pigment to be used include C.I. Pigment Blue 2, 3, 15, 16 and 17, C.I. Bat Blue 6, C.I. Acid Blue 45, or a Copper Phthalocyanine Pigment having from 1 to 5 phthaloimidemethyl groups substituted on a phthalocyanine structure.

Examples of a yellow coloring pigment to be used include C.I. Pigment Yellow 1, 2, 3, 4, 5, 6, 7, 10, 11, 12, 13, 14, 15, 16, 17, 23, 65, 73 and 83, C.I. Bat Yellow 1, 3 and 20, and the like.

These coloring agents are used in a non-magnetic toner in an amount of from 0.1 to 60 parts by mass, preferably from 0.5 to 50 parts by mass, per 100 parts by mass of a binder resin.

Examples of a release agent used to improve a fixing property include conventional known release agents such as a low molecular weight polyalkylene, a terpene resin and their derivatives and various waxes. Examples of the waxes include a low molecular weight polypropylene, a low molecular weight polyethylene, a paraffin wax, and their derivatives, microcrystalline wax and their derivatives, Fischer-Tropsch wax and their derivatives, polyolefin wax and their derivatives, terpene resin and their derivatives, carnauba wax and their derivatives, and these derivatives include an oxide, a block copolymer with a vinyl type monomer, a graft-modified material, and the like. Preferable release agents are various waxes.

In order to more effectively achieve the effect provided by adding wax in from a low temperature zone to a high temperature zone, the toner may contain at least two kinds of waxes.

In such a case, the wax to be used preferably has at least two heat-absorbing peaks measured by differential thermal analysis (DSC), and a peak of the highest heat-absorbing amount is present preferably at a lower temperature side than a peak of a second highest peak. As such a wax, a combination of at least two kinds of waxes having respectively different heat-absorbing peaks may be used, and a mixture having at least two DSC peaks may be used as a wax.

The wax preferably has two heat-absorbing peaks measured by DSC, and the two peaks preferably have a temperature difference of from 5 to 15° C. If the temperature difference is less than 5° C., the above-mentioned effect can be hardly achieved, and if the temperature difference exceeds 15° C., a low temperature side component provides an unpreferable influence on storage properties or a high temperature side component provides an unfavorable influence on fixing properties. Also, if the temperature difference between two heat-absorbing peaks is too large, dispersibility and liberation properties of the both components in the toner are different, and such a toner having a small particle size as used in the present invention suffers from an unpreferable dispersion influence of ununiform wax components, thereby adversely affecting a charging performance.

Such a wax includes a compound represented by the following formula (8) (wherein R is a hydrocarbon group and Y is a hydroxyl group, a carboxyl group, an alkylether group, an ester group or a sulfonyl group) having a mass average molecular weight (Mw) of at most 3,000 measured by GPC (gel permeation chromatography). Formula 8

$$R—Y \quad (8)$$

Examples of the compound include (A) $CH_3(CH_2)_nCH_2OH$ (n=about 20 to about 300)

(B) $CH_3(CH_2)_nCH_2COOH$ (n=about 20 to about 300)

(C) $CH_3(CH_2)_nCH_2OCH_2(CH_2)_mCH_3$ (n=about 20 to about 200, m=0 to about 100). The above compounds (B) and (C) are derivatives of the compound (A), and the main chain is a linear chain-like saturated hydrocarbon. In addition to the above illustrated examples, any compound derived from the above compound (A) may be used.

Among the above compounds, a wax comprising a high molecular alcohol represented by the above compound (A) as the main component achieves a satisfactory effect and is preferable. The above wax provides a satisfactory sliding property and particularly an excellent offset resistance. Also, when a toner is prepared so as to have a smaller particle size, it becomes important to disperse a wax uniformly, but the above wax has a coaction with a binder resin in the toner, and can be uniformly dispersed in the toner since the above wax itself does not have a high crystallinity.

These wax are used preferably in an amount of from 0.5 to 20 parts by mass per 100 parts by mass a binder resin.

Further, the toner of the present invention may contain a fluidity-improving agent. By adding the fluidity-improving agent to the surface of the toner, a fluidity is increased as compared before and after adding the fluidity-improving agent. Examples of the fluidity-improving agent include a fluorine type resin powder such as vinylidene fluoride fine powder, polytetrafluoroethylene fine powder or the like, a silica fine powder such as wet process-produced silica or dry process-produced silica, a titanium oxide fine powder, an alumina fine powder, and a treated silica, a treated titanium oxide or a treated alumina which is surface-treated with a silane coupling agent, a titanium coupling agent or a silicone oil.

Examples of a preferable fluidity-improving agent include fine powders produced by vapor phase oxidation of a silicone halide compound such as dry process-produced silica or fumed silica. For example, such silica can be obtained by thermal decomposition oxidation reaction of silicone tetrachloride gas in oxyhydrogen flame as illustrated by the following reaction formula.

$$SiCl_4+2H_2+O_2 \rightarrow SiO_2+4HCl$$

In the above preparation step, it is possible to obtain a composite fine powder of silica and other metal oxides by using a silicone halide in combination with other metal halide compounds such as aluminum chloride or titanium chloride, and the term "silica" includes them. A silica fine powder to be used preferably has an average primary particle size in a range of from 0.001 to 2 $\mu$m, more preferably in a range of from 0.002 to 0.2 $\mu$m.

A silica fine powder produced by vapor phase oxidation of silicone halide is commercially available under the following trade names: AEROSIL 130 (manufactured by Nihon Aerosil K.K.), AEROSIL 200 (manufactured by Nihon Aerosil K.K.), AEROSIL 300 (manufactured by Nihon Aerosil K.K.), AEROSIL 380 (manufactured by Nihon Aerosil K.K.), AEROSIL TT600 (manufactured by Nihon Aerosil K.K.), AEROSIL MOX170 (manufactured by Nihon Aerosil K.K.), AEROSIL MOX80 (manufactured by Nihon Aerosil K.K.), AEROSIL COK84 (manufactured by Nihon Aerosil K.K.), Ca-O-SiL M-5 (manufactured by CABOT Co.), Ca-O-SiL MS-7 (manufactured by CABOT Co.), Ca-O-SiL MS-75 (manufactured by CABOT Co.), Ca-O-SiL HS-5 (manufactured by CABOT Co.), Ca-O-SiL EH-5 (manufactured by CABOT Co.), Wacker HDK N20 V15 (manufactured by WACKER-CHEMIEGMBH), N20E (manufactured by WACKER-CHEMIEGMBH), T30 (manufactured by WACKER-CHEMIEGMBH), T40 (manufactured by WACKER-CHEMIEGMBH), D-C Fine-Silica (Dow Corning Co.), Fransol (Fransil Co.), and the like.

Further, a treated silica fine powder of the above silicone halide compound obtained by gas phase oxidation of the silicone halide compound and subjected to hydrophobic treatment is more preferable. Still further, among the treated silica fine powders, a silica fine powder treated so as to have a hydrophobicity (hydrophobic degree) of in a range of from 30 to 80 measured by methanol titration test is particularly preferable.

The hydrophobic treatment is carried out by chemically treating a silica fine powder with an organic silica compound reactive or physically adsorptive with the silica fine powder. As a preferable treatment process, a silica fine powder obtained by subjecting a silica halide compound to vapor phase oxidation is treated with an organic silicone compound.

Examples of the organic silicone compound include hexamethyldisilane, trimethylsilane, trimethylchlorosilane, trimethylethoxysilane, dimethyldichlorosilane, methyltrichlorosilane, aryldimethylchlorosilane, arylphenyldichlorosilane, benzyldimethylchlorosilane, bromomethyldimethylchlorosilane, α-chloroethyltrichlorosilane, ρ-chloroethyltrichlorosilane, chloromethyldimethylchlorosilane, triorganosilylmercaptan, trimethylsilylmercaptan, triorganosilylacrylatevinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane and dimethylpolysiloxane having 2 to 12 siloxane units per molecule and also having a hydroxyl group bonded respectively to one Si in the terminal. A further example includes a silicone oil such as dimethylsilicone oil. They are used respectively alone or in a mixture of two or more.

A fluidity-improving agent having a specific surface area of at least 30 $m^2/g$, preferably at least 50 $m^2/g$, measured on the basis of nitrogen adsorption measured by BET method, provides a satisfactory result. The fluidity-improving agent is used preferably in an amount of from 0.01 to 8 parts by mass, more preferably in an amount of 0.1 to 4 parts by mass, per 100 parts by mass of a toner.

The electrostatic image developing toner of the present invention may further contain other additives such as various metal soaps, a fluorine type surfactant, dioctyl phthalate and the like, in order to protect a photosensitive material and a carrier, to improve a cleaning property, to adjust thermal, electric or physical properties, to adjust a resistance, to adjust a softening point, to improve a fixing rate, or the like, and may further include an electroconductivity-imparting agent such as tin oxide, zinc oxide, carbon black and antimony oxide, and inorganic fine powders such as titanium oxide, aluminum oxide and alumina, and the like. Also, these inorganic fine powders may be optionally subjected to hydrophobic treatment.

Also, the toner may further contain a lubricant such as Teflon, (registered trademark) zinc stearate, or vinylidene polyfluoride, an abradant such as cesium oxide, silicone carbide or strontium titanate, an anti-caking agent, and a development-improving agent such as black fine particles and white fine particles having a reverse polarity to the toner particles in a small amount.

In order to control a charging amount, these additives are preferably treated with various treating agents including a silicone varnish, various modified silicone varnishes, a silicone oil, various modified silicone oils, a silane coupling agent, a silane coupling agent having a functional group, and other organic silicone compounds or the like.

A toner and the above-mentioned additives are fully mixed and stirred by a mixer such as a Henschel mixer, a ball mill or the like to have the surface of toner particles uniformly treated with the above additives, thereby obtaining a desired electrostatic image developing toner.

The charge control agent of the present invention is thermally stable and can retain a stable chargeability without being susceptive to a thermal change. Also, since it is uniformly dispersed in any binder resin, a charge distribution of a fresh toner becomes very uniform, and the toner of the present invention including untransferred and recovered toner (used toner) does not provide a substantial change in a saturated tribo-charged amount and a charge distribution as compared with a fresh toner. When a used toner provided from the electrostatic image developing toner of the present invention is reused, it is possible to further make a difference between the fresh toner and the used toner smaller by preparing a toner using a polyester resin including an aliphatic diol as a binder resin or a metal-crosslinked styrene-acryl copolymer as a binder resin and also using a large amount of polyolefin added thereto.

When using a toner of the present invention as a two-component developer, examples of a carrier to be used include fine glass beads, iron powder, ferrite powder, nickel powder, a binder type carrier of resin particles having magnetic particles dispersed therein, and a resin-coated carrier, the surface of the carrier of which is coated with a polyester type resin, a fluorine type resin, a vinyl type resin, an acryl type resin or a silicone type resin.

The carrier thus used has a particle size in a range of from 4 to 200 μm, preferably from 10 to 150 μm, more preferably from 20 to 100 μm.

In the two-component developer, a toner is used preferably in an amount of from 1 to 200 parts by weight per 100 parts by weight of a carrier, and more preferably a toner is used in an amount of from 2 to 50 parts by weight per 100 parts by weight of a carrier.

The toner of the present invention can be used in a one-component developing system which is another image-forming method. The one-component developing system means a developing unit of a method comprising coating a toner on the surface of a toner-carrying material called as a developing roller and developing in contact with or in non-contact with the surface of a photosensitive material. In such a case, the toner may be magnetic or non-magnetic. The developing roller may comprises a material, the resistance of which is controlled in a medium resistance zone so as to maintain an electric field while preventing a conductivity to the surface of a photosensitive material, or a thin layer of dielectric layer may be provided on the surface layer of an electroconductive roller. Further, there may be employed a developing system using an electroconductive resin sleeve having an insulating material coated on the side faced to the surface of a photosensitive material on an electroconductive roller or an insulating sleeve having an electroconductive layer provided on the side not faced to a photosensitive layer.

When the toner of the present invention is used for one-component contact developing method, the surface of a roller carrying the toner may be rotated in the same direction of peripheral velocity as that of a photosensitive material, or may be rotated in the reverse direction. If a peripheral velocity ratio (roller peripheral velocity/photosensitive material peripheral velocity) becomes higher, an amount of toner supplied to a developing part becomes larger and the toner is more frequently adsorbed and desorbed to a latent image. By repeating to remove the toner on an unnecessary part and to supply the toner to a necessary part, a latent image is faithfully developed, and in such a system, the peripheral velocity ratio is preferably required to be higher.

The toner of the present invention can be used also in a system wherein a toner-carrying material and an electrostatic latent image-holding material are in non-contact with each other, and the toner may be magnetic or non-magnetic. Usually, when developing in the non-contact state, development is carried out by flying the toner between a certain distance space, and it is therefore necessary to produce an electric field between the developer and the latent image-holding material. In such a case, it is usual to apply a direct current electric field, but it is also possible to apply an alternating current in order to make a clear image satisfactorily developed at edge parts and to satisfactorily develop a solid image.

When employing one-component developing system as a developing system using the toner of the present invention, a stiff roller may be used as a toner-carrying material, and a photosensitive material can be made flexible like a belt, or an elastic roller may be used. When using a developing roller of electroconductive material as a toner-carrying material, the developing roller has a resistivity preferably in a range of from $10^1$ to $10^{12}$ Ω·cm, more preferably in a range of from $10^2$ to $10^9$ Ω·cm.

Further, in the development of the toner of the present invention, it is preferable to coat the surface of the toner-carrying material with a resin layer having electroconductive fine particles and/or a lubricant dispersed in order to control a total charge amount of the toner.

A two-component developing system of using the toner of the present invention is concretely described hereinafter. The two-component developing system employs a toner and a carrier (having functions as a charge-imparting material and a toner-conveying material), and examples of the carrier used include a magnetic material, glass beads and the like. By stirring a developer (a toner and a carrier) by a developer-stirring element, a predetermined charge amount is generated and is conveyed by a magnet roller to a part where development is carried out. By a magnetic force of the magnet roller, the developer is retained on the surface of the roller, and the developer is formed into a layer of appropriate height restricted by a developer-restricting plate forming a magnetic brush. The developer moves on the roller in accordance with rotation of a developing roller in a contact state with an electrostatic latent image-holding material or in non-contact state at a predetermined distance so as to be faced to the electrostatic latent image-holding material, and the latent image is developed into a visible image. In the development in the non-contact state, it is usual to produce a direct current electric field between the developer and the latent image-holding material, thereby providing a driving force for flying the toner between a predetermined distance space, or an alternating current field may be produced in order to make a clearer image.

A preferable embodiment of a photosensitive material used in an image-forming apparatus to be used for the electrostatic image developing toner of the present invention is illustrated below.

Examples of an electroconductive substrate include a metal such as aluminum or stainless steel, a plastic having a coating layer of an aluminum alloy, an indium oxide-tin oxide alloy or the like, a plastic or paper having electroconductive particles impregnated, a plastic having an electroconductive polymer, and the like, and the electroconductive substrate may be used in a cylindrical form or a film form.

These electroconductive substrates may be provided with an undercoat layer in order to improve a coating property or adhesiveness of a photosensitive layer, to protect the substrate, to cover a defect present on the substrate, to improve a charge-introducing property from a black material, or to prevent a photosensitive layer from being electrically destroyed. Examples of the undercoat layer include polyvinyl alcohol, poly-N-vinyl imidazole, polyethylene oxide, ethyl cellulose, methyl cellulose, nitrocellulose, ethylene-acrylic acid copolymer, polyvinyl butyral, phenol resin, casein, polyamide, copolymerized nylon, glue (hydoglue), gelatin, polyurethane, aluminum oxide and the like. The undercoat layer usually has a thickness of from 0.1 to 10 μm, preferably from 0.1 to 3 μm.

A charge-generating layer is formed by coating a charge-generating material dispersed in an appropriate binder or vapor-depositing, the charge-generating material of which include an azo type pigment, a phthalocyanine type pigment, an indigo type pigment, a perylene type pigment, a polycyclic quinone type pigment, a squarilium dye, a pyrylium salt, a thiopyrylium salt, a triphenylmethane type dye, and an inorganic material such as selenium or amorphous silicon. Among them, a phthalocyanine type pigment is preferable. The binder is used in an amount of at most 80 mass %, preferably from 0 to 40 mass %, to the charge-generating layer. Also, the charge-generating layer has a film thickness of at most 5 μm, preferably from 0.05 to 2 μm.

A charge-transporting layer has a function of receiving a charge carrier from a charge-generating layer under electric field and transporting the charge carrier. The charge-transporting layer is formed by dissolving a charge-transporting material in a solvent, optionally together with a binder resin, and coating, and its film thickness is generally from 5 to 40 μm. Examples of the charge-transporting material include a polycyclic aromatic compound having a structure of biphenylene, anthracene, pyrene or phenanthrene in the main chain or in a side chain, a nitrogen-containing cyclic compound such as indole, carbazole, oxadiazole or pyrazoline, a hydrazone compound, a styryl compound, selenium, selenium-tellurium, amorphous silicone or cadmium sulfide, and the like.

Examples of a binder resin having these charge-transporting material dispersed therein, include a resin such as polycarbonate resin, polyester resin, polymethacrylic acid ester, polystyrene resin, acryl resin or polyamide resin, and an organic photoconductive polymer such as poly-N-vinyl carbazole or polyvinyl anthracene, and the like.

Further, a protective layer may be provided as a surface layer. Examples of a resin used as the protective layer include polyester, polycarbonate, acryl resin, epoxy resin and phenol resin, or these resins are used in combination with one or two or more curing agents. Also, electroconductive fine particles may be dispersed in a resin of the protective layer. Examples of the electroconductive fine particles include a metal, a metal oxide and the like. Preferably ultra-fine particles of zinc oxide, titanium oxide, tin oxide, antimony oxide, indium oxide, bismuth oxide, tin oxide-coated titanium oxide, tin-coated indium oxide, antimony-coated tin oxide, zirconium oxide or the like. They may be used alone or in a mixture of two or more. Generally, when dispersing particles in a protective layer, it is necessary for preventing scattering of an incident light by dispersion particles to employ dispersion particles having a particle size smaller than a wavelength of the incident light, and it is preferable to use electroconductive or insulating particles having a particle size of at most 0.5 μm to be dispersed in the protective layer. Also, the particles are used preferably in an amount of from 2 to 90 mass %, more preferably from 5 to 80 mass %, to the total weight of the protective layer. The protective layer has preferably a film thickness of from 0.1 to 10 μm, more preferably from 1 to 7 μm.

Coating of a surface layer is carried out by spray-coating, beam-coating or dip-coating a resin dispersion.

As a charging method for these photosensitive materials, a well known corona-charging method such as corotron or scorotron may be used, or a method of using a pin electrode may also be used. Further, a direct-charging method as described below can also be used. As the direct-charging method, there are a method of using a charging blade and a method of using an electroconductive brush. These contact-charging methods provide an advantage of not using a high electric voltage and an effect of reducing generation of ozone.

When using a roller or a blade as a direct-charging element of a photosensitive material, a metal such as iron, copper or stainless steel, a resin having carbon dispersed or a resin having a metal or a metal oxide dispersed, and the like are used as an electroconductive substrate, and its shape to be used is bar-like or plate-like. For example, when using an elastic roller having an elastic layer, an electroconductive layer and a resistance layer provided on an electroconductive substrate, the elastic layer of the elastic roller may be formed from a rubber or a sponge of chloroprene rubber, isoprene rubber, EPDM rubber, polyurethane rubber, epoxy rubber, butyl rubber or the like, or a thermoplastic elastomer such as styrene-butadiene thermoplastic elastomer, polyurethane type thermoplastic elastomer, polyester type thermoplastic elastomer, ethylene-vinyl acetate thermoplastic elastomer or the like, and the electroconductive layer has a volume resistivity of at most $10^7$ Ω·cm, preferably at most $10^6$ Ω·cm.

For example, a metal vapor-deposition film, an electroconductive particle-dispersing resin, an electroconductive resin or the like is used, and examples of the metal vapor-deposition film include a vapor-deposition film of aluminum, indium, nickel, copper or iron, and examples of the electroconductive particle-dispersing resin include a resin of urethane, polyester, vinyl acetate-vinyl chloride copolymer or polymethyl methacrylate, having electroconductive particles of carbon, aluminum, nickel or titanium oxide dispersed. Examples of the electroconductive resin include quaternary ammonium salt-containing polymethyl methacrylate, polyvinyl aniline, polyvinyl pyrrole, polydiacetylene, polyethyleneimine and the like. The resistance layer is for example a layer having a volume resistivity of $10^6$ to $10^{12}$ Ω·cm, and a semiconductive resin, an electroconductive particle-dispersing insulating resin or the like may be used. Examples of the semiconductive resin include ethyl cellulose, nitrocellulose, methoxymethylated nylon, ethoxymethylated nylon, copolymerized nylon, polyvinyl hydrin, casein and the like. Examples of the electroconductive particle-dispersing resin include an insulating resin of urethane, polyester, vinyl acetate-vinyl chloride copolymer or polymethyl methacrylate, having electroconductive particles of carbon, aluminum, indium oxide or titanium oxide dispersed in a small amount.

A brush used as the charging element is prepared by dispersing an electroconductive material in generally used fibers to adjust a resistance. Examples of the fibers include generally known fibers such as nylon, acryl, rayon, polycarbonate, polyester or the like. Also, examples of the electroconductive material include electroconductive powders of generally known electroconductive materials such as a metal of copper, nickel, iron, aluminum, gold or silver, or a metal oxide of iron oxide, zinc oxide, tin oxide, antimony oxide or titanium oxide, and carbon black. If necessary, these electroconductive powders may be surface-treated by hydrophobic treatment or resistivity-adjusting treatment. The electroconductive powders to be used are selected in view of productivity and dispersibility in fibers. The brush is prepared preferably so as to have a fiber thickness of from 1 to 20 denier (fiber diameter: from 10 to 500 μm), a fiber length of from 1 to 15 mm and a brush density of from 10,000 to 300,000 filaments per $inch^2$ (from 1.5×100 to 4.5×100 filaments per $cm^2$).

An image-forming method applicable for the electrostatic image developing toner of the present invention is concretely described hereinafter with regard to a transferring step.

The transfer is carried out by electrostatically transferring an image to be developed to a transfer material by using a photosensitive material and a transfer material in a contact or non-contact state.

The non-contact transferring method employs a transferring step by a well known corona charging method such as corotron or scorotron.

The contact transferring method employs a transferring roller or an apparatus having a transferring belt as transferring means. The transferring roller comprises at least a mandrel and an electroconductive elastic layer, and the electroconductive elastic layer employs an elastomer having a resistivity of from $10^1$ to $10^{10}$ Ω·cm such as urethane or EPDM and having an electroconductive material such as carbon dispersed therein.

The electrostatic image developing toner of the present invention is particularly effective for an image-forming apparatus employing an organic compound on the surface of a photosensitive material. Generally, when the surface layer of a photosensitive material is formed by an organic compound, a transferring performance tends to be lowered as compared with a photosensitive material using an inorganic material since the organic compound surface layer has a stronger adhesiveness to toner particles, but since the toner of the present invention has an excellent charge controlling effect, a remaining amount of transferred toner is very small and a transferring efficiency is excellent.

Examples of the surface material of a photosensitive material employed in an image-forming apparatus applicable for the electrostatic image developing toner of the present invention, include silicone resin, vinylidene chloride, ethylene-vinyl chloride, styrene-acrylonitrile, styrene-methylmethacrylate, styrene, polyethylene terephthalate and polycarbonate, but are not limited thereto, and other monomers or copolymers and blends of the above illustrated binder resins are also usable.

The toner of the present invention is also useful for an image-forming apparatus employing a photosensitive material of small size having a diameter of at most 50 mm.

Also, when forming a color image, a well-known intermediate transferring belt is usable as a color-overlapping means.

As a cleaning element, a blade, a roller, a fur brush, a magnetic brush or the like can be used in an image-forming apparatus applicable for the electrostatic image developing toner of the present invention. These cleaning elements may be used in a combination of two or more kinds.

Various methods may be used as a method for cleaning an electrostatic image-holding material in an image-forming apparatus applicable for the electrostatic image developing toner of the present invention. An efficient blade cleaning method may be employed, but as a means for simply improving a cleaning defect by a toner, there is illustrated a method for appropriately controlling without excessively raising a charge of untransferred toner remained on a photosensitive material.

Also, it is preferable to impart a release property to the surface of a photosensitive material used in an image-forming apparatus applicable for the electrostatic image developing toner of the present invention, and it is preferable to make the surface of a photosensitive material so as to have a contact angle of at least 85° to water. More preferably, the surface of a photosensitive material has a contact angle of at least 90° to water. The photosensitive material surface having such a high contact angle means to have a high release property, and due to this effect, a toner amount remained after transferring can be remarkably reduced, and a load of cleaning can be largely reduced. Thus, by using the toner of the present invention, generation of a cleaning defect can be surely prevented.

The image-forming apparatus applicable for the electrostatic image developing toner of the present invention is useful also in a case of using a photosensitive material having a surface mainly composed of a high molecular binder resin. For example, an image-forming apparatus is useful in a case of using an inorganic photosensitive material such as selenium or amorphous silicon, on the surface of which a protective film mainly composed of a resin is provided, a case of having a surface layer composed of a resin and a charge-transporting material as a charge-transporting layer of a function-separation type organic photosensitive material, and a case of having a protective layer further provided thereon. A means for imparting a release property to such a surface layer comprises using a resin having a low surface energy for constituting a film, adding an additive of imparting water repellency or lipophilic nature, or dispersing a material having a high release property.

More concrete means comprises introducing a fluorine-containing group, a silicon-containing group or the like into a structure of a resin, adding a surfactant or the like, or forming a surface layer of a fluorine atom-containing compound such as polyethylene fluoride, polyvinylidene fluoride, carbon fluoride or the like. By employing these means, it is possible to produce a photosensitive material surface having a contact angle of at least 85° to water. If the contact angle is less than 85°, a toner and a toner-carrying material are hardly endurable and tend to be degraded. Among these means, it is particularly preferable to employ polyethylene fluoride, and it is preferable to disperse a release property-imparting powder such as a fluorine-containing resin into an outermost surface layer. The incorporation of the powder into the surface can be carried out by providing a layer having the powder dispersed in a binder resin on the outermost surface of a photosensitive material, or by dispersing the powder directly in the outermost surface layer without providing a new surface layer in a case of an organic photosensitive material mainly composed of a resin.

An amount of the powder to be incorporated into the surface layer is preferably adjusted so as to provide an appropriate sensitivity suitable in the present invention.

Examples of a binder resin include polycarbonate resin, polyester resin, polyvinyl butyral resin, polystyrene resin, acryl resin, methacrylic resin, phenol resin, silicone resin, epoxy resin, vinyl acetate resin and the like. An amount of the release property-imparting powder is preferably from 1 to 60 mass %, more preferably from 2 to 50 mass %, to the total weight of a charge-generating layer and a surface layer. If the amount of the powder is less than 1 mass %, an amount of a toner remained after transferring is not sufficiently reduced, and a cleaning efficiency of the toner remained after transferring is not satisfactory, and accordingly an effect of preventing a ghost is not satisfactory. On the other hand, if the amount of the powder is higher than 60 mass %, a strength of a film is unpreferably lowered or an amount of light incident on a photosensitive material is remarkably lowered. A particle size of the powder is preferably at most 1 μm, more preferably at most 0.5 μm, in view of an image quality. If the particle size of the powder is larger than 1 μm, an incident light scatters and an image of a line does not become sharp and is practically unusable. On the other hand, a technique of cleaning at the same time as development or a cleaningless technique as disclosed in JP-A-5-2287 is also applicable for the toner of the present invention.

A conventionally known system can be employed as an image-forming apparatus applicable for the electrostatic image developing toner of the present invention, examples of which include a system of heating under pressure using a heat roller, a system of fixing by flash for high-speed fixing, or the like. In the system of heating under pressure using a heat roller, fixing is carried out by passing a fixing sheet having a toner image on the surface under pressure by a heat roller, the surface of which is prepared by a material having a release property to the toner. According to this system, since the toner image of the fixing sheet is made contact with the surface of the heat roller under pressure, a heat efficiency for melting the toner image on the fixing sheet is very satisfactory, and the fixing can be promptly carried out so as to be very effective for a high-speed electrophotographic copying machine.

In place of the system of heating under pressure by the heat roller, another fixing system may be employed, which comprises placing a recording material in contact with a heated material intervening a film under pressure by a pressing member.

In order to improve an offset property so as not to have a toner attached to the surface of a fixing roller, the surface of the roller may be composed of a material having an excellent release property (such as a fluorine type resin) to a toner and an offset-improving liquid such as a silicone oil is further applied to the surface to coat a thin film of the offset-improving liquid on the roller surface, thereby achieving a very high effect.

When using a toner softened by heat, which is easily attached to a developing roller, an electrostatic image-holding material, a contact charging element and the like, it is effective for improving a fixing performance to incorporate a low molecular weight component such as a wax component into a toner.

In the electrostatic developing toner of the present invention, in view of image property and productivity of the toner, the toner should preferably have an average particle size based on volume in the range of from 2 to 15 μm as measured by a laser type particle size distribution-measuring machine such as micronsizer (manufactured by Seishin Kigyo K.K.). A more preferable average particle size is in a range of from 3 to 12 μm. If the average particle size exceeds 15 μm, resolving power and sharpness become poor, and if the average particle size is less than 2 μm, the resolving power is satisfactory, but a yield of toner production becomes low and a production cost becomes high, and various tendency that a problem of scattering of a toner in a machine and a health problem due to invasion of a toner into a human skin are caused.

With regard to a particle size distribution of the electrostatic image developing toner of the present invention, by measuring a particle size by a COULTER COUNTER (TA-II manufactured by COULTER Co.), a content of particles having a particle size of at most 2 μm is preferably in a range of from 10 to 90% on the basis of the number of particles, and a content of particles having a particle size of at least 12.7 μm is preferably in a range of from 0 to 30% on the basis of volume.

The electrostatic image developing toner of the present invention preferably has a specific surface area in a range of from 1.2 to 5.0 $m^2/g$, more preferably in a range of from 1.5 to 3.0 $m^2/g$, as measured by BET specific surface area measurement using nitrogen as a desorption-adsorption gas. The measurement is carried out by using a BET specific surface area measuring apparatus (Flow SorbII2300, manufactured by Shimadzu Seisakusyo K.K.), and a specific surface area is defined as a value determined from a desorbed gas amount measured by desorbing an adsorbed gas on a toner surface at 50° C. for 30 minutes, adsorbing a nitrogen gas again by rapidly cooling with liquid nitrogen, and heating to 50° C. again for carrying out desorption again.

An apparent specific gravity (bulk density) of the electrostatic image developing toner of the present invention is measured by using a powder tester (manufactured by Hosokawa Micron K.K.) and using a container attached to the measuring apparatus in accordance with the manual of this measuring apparatus. When the toner of the present invention is a non-magnetic toner, the toner should preferably have an apparent specific gravity of from 0.2 to 0.6 g/cc, and when the toner of the present invention is a magnetic toner, the toner should preferably have an apparent specific gravity of from 0.2 to 2.0 g/cc although it may vary depending on a content and a type of a magnetic powder used.

When the electrostatic image developing toner of the present invention is a non-magnetic toner, a toner should preferably have a true specific gravity of from 0.9 to 1.2 g/cc, and when the toner is a magnetic toner, the toner should preferably have a true specific gravity of from 0.9 to 4.0 g/cc although it varies depending on a content and a type of a magnetic powder used. The true specific gravity of the toner is measured by accurately measuring a weight of 1.000 g of toner, placing the measured toner in a 10 mmΦ tablet-molding machine, press-molding under a pressure of $196\times10^5$ Pa (200 $kgf/cm^2$) in vacuum, and measuring a height of the molded product of cylindrical shape by a micrometer, thereby calculating a true specific gravity.

A fluidity of a toner is defined as a flow angle of repose and a static angle of repose measured by a Tsutsui type repose angle-measuring apparatus (manufactured by Tsutsui Rika K.K.). The electrostatic image developing toner using a charge control agent of the present invention preferably has a flow angle of repose of from 5° to 45° and a static angle of repose of from 10° to 50°.

In case of a pulverized type toner, an electrostatic image developing toner of the present invention should preferably have a shape coefficient (SF-1) of from 120 to 400 and a shape coefficient (SF-2) of from 110 to 350.

In the present invention, shape coefficients SF-1 and SF-2 of a toner are calculated by sampling a group of about 30 product particles as an image enlarged 1,000 times in one view by an optical microscope (such as BH-2, manufactured by Olympus Optical Co., Ltd.) equipped with a CCD camera, transferring obtained images to an image analyzing apparatus (such as Luzex FS® manufactured by Nireko K.K.), measuring a maximum length of an image of one particle (maximum length ML of particle), an area of an image of one particle (projected area A of particle) and a circumference length of an image of one particle (circumference length PM of particle), and substituting measured values of each particle for the following calculation formulae to obtain an average particle. The above measurement operation is repeated until measuring about 3,000 particles of one product, and shape coefficients SF-1 and SF-2 of each toner are expressed by average values of measured values of all particles.

$$SF\text{-}1=((ML^2\times\pi)/4A)\times100$$

(In the above formula, ML is a maximum length of a particle and A is a projected area of one particle.)

$$SF\text{-}2=(PM^2/4A\pi)\times100$$

(In the above formula, PM is a circumference length of a particle and A is a projected area of one particle.)

SF-1 expresses a strain of a particle, and if a particle becomes closer to a sphere, an SF-1 value becomes closer to 100, and if this value becomes larger, a particle becomes longer and narrower. On the other hand, SF-2 expresses an irregularity degree of a particle surface, and if a particle becomes closer to a sphere, an SF-2 value becomes closer to 100, and if a particle shape becomes more complicated, an SF-2 value becomes larger.

The electrostatic image developing toner of the present invention preferably has a volume resistivity of from $1\times10^{12}$ to $1\times10^{16}$ Ω·cm in a case of a non-magnetic toner and also has a volume resistivity of from $1\times10^{8}$ to $1\times10^{16}$ Ω·cm in a case of a magnetic toner although it varies depending on a content and a type of a magnetic powder used. The volume resistivity of the toner is measured by pressure-molding toner particles into a disk-like test piece having a diameter of 50 mm and a thickness of 2 mm, fixing the test piece on an electrode for solid (SE-70 manufactured by Ando Denki K.K.), and measuring a resistance value one hour after continuously applying a direct current voltage of 100 V by using a high insulating resistance meter (4339A manufactured by Hughlet Packard Co.).

The electrostatic developing toner of the present invention preferably has a dielectric dissipation factor of from $1.0\times10^{-3}$ to $15.0\times10^{-3}$ in a case of a non-magnetic toner and also has a dielectric dissipation factor of from $2\times10^{-3}$ to $30\times10^{-3}$ in a case of a magnetic toner although it varies depending on a content and a kind of a magnetic powder used. The volume resistivity of the toner is measured by pressure-molding toner particles into a disk-like test piece having a diameter of 50 mm and a thickness of 2 mm, fixing the test piece on an electrode for solid, and measuring a dielectric dissipation factor (Tan δ) value obtained by applying a frequency of 1 KHz and a peak to peak voltage of 0.1 KV by using a LCR meter (4284A manufactured by Hughlet Packard Co.).

The electrostatic image developing toner of the present invention preferably has an Izod impact strength of from 0.1 to 30 kg·cm/cm. The Izod impact strength of the toner is measured by subjecting a plate-like test piece prepared by heat-melting toner particles to a test of JIS standard K-7110 (impact strength test method of rigid plastic).

The electrostatic image developing toner of the present invention preferably has a melt index (MI value) of from 10 to 150 g/10 min. The melt index (MI value) of the toner is measured at a temperature of 125° C. under a load of 10 kg in accordance with JIS standard K-7210 (A method).

The electrostatic image developing toner of the present invention preferably has a melting-initiating temperature in a range of from 80 to 180° C., and also has a 4 mm-offset temperature in a range of from 90 to 220° C. The melt-initiating temperature of the toner is measured by pressure-molding toner particles into a cylindrical test piece having a diameter of 10 mm and a thickness of 20 mm, setting the test piece in a heat-melting property-measuring apparatus, e.g. a flow tester (CFT-500C manufactured by Shimadzu Seisakusyo K.K.) and measuring a temperature value, at which a piston begins to descend under a load of $196\times10^4$ Pa (20 kgf/cm$^2$ ) at the initiation of melting. The 4 mm descending temperature of the toner is measured by measuring a temperature value, at which a piston descends 4 mm in the same test as above.

The electrostatic image developing toner of the present invention preferably has a glass transition temperature (Tg) in a range of from 45 to 80° C., more preferably in a range of from 55 to 75° C. The glass transition temperature of the toner is measured from a peak value of a phase change appeared when raising a temperature at a constant rate, rapidly cooling and raising a temperature again by using a differential thermogravimetry apparatus (DSC). When the Tg value of the toner is lower than 45° C., an offset resistance and a storage stability become poor and when the Tg value exceeds 80° C., a fixing strength of an image is lowered.

The electrostatic image developing toner of the present invention preferably has a mass average molecular weight (Mw) in a range of from 50,000 to 3,000,000. Also, a Mw/Nm ratio showing a molecular weight distribution is preferably in a range of from 3 to 500. The molecular weight distribution may have only one peak or may have a plurality of peaks of two or more. The molecular weight of the toner is measured by dissolving a predetermined amount of toner particles in an organic solvent such as THF, removing an undissolved material by filtrating with a filter and subjecting the dissolved material only to GPC (gel permeation chromatography).

Among resin components of the electrostatic image developing toner of the present invention, a gel-like component insoluble in tetrahydrofuran (THF) preferably has a mass average molecular weight (Mw) in a range of from 500,000 to 6,000,000. Also, a Mw/Nm ratio illustrating a molecular weight distribution is preferably in a range of from 3 to 500. The molecular weight distribution may have only one peak or may have a plurality of peaks of two or more. The gel-like component is preferably in an amount of from 0 to 30 mass % to the total resin constituting the toner.

The electrostatic image developing toner of the present invention preferably has a melt viscosity in a range of from 100 to 500 Pa·s (from 1,000 to 50,000 poises), more preferably from 150 to 3,800 Pa·s (from 1,500 to 38,000 poises). The melt viscosity of the toner is measured by pressure-molding toner particles into a cylindrical test piece having a diameter of 10 mm and a thickness of 2 cm, setting the test piece in a heat melt property-measuring apparatus, e.g. a flow tester (CFT-500C manufactured by Shimadzu Seisakusyo K.K.), and measuring the melt viscosity under a load of $196\times10^4$ Pa (20 kgf/cm$^2$).

It is preferable that a calcium product as a charge controlling agent of the present invention should be present on a surface of an electrostatic image developing toner in an amount of at least 2.0 mg, more preferably at least 2.5 mg, per 1 g of the toner. The amount of the calcium product present on the toner surface (surface presence ratio) is determined by fully washing the calcium product on the toner surface with an organic solvent such as methyl alcohol dissolving only the calcium product and not dissolving a resin, a coloring agent and a wax of the toner and measuring a concentration of the washing solution in accordance with a calorimetric method using a fluorescence spectrophotometer or the like.

For example, the surface presence ratio of the calcium product of the present invention can be measured in the following manner.

First, respective methanol solutions having concentrations 2 ppm, 5 ppm, 10 ppm and 20 ppm of a calcium product of the present invention are prepared. These solutions are measured by a fluorescence spectrometer. At this time, an analytical curve is made from a solution concentration and a maximum fluorescence intensity. Thereafter, 0.2 g of a toner containing a calcium product of each of the Examples and Comparative Examples is accurately weighed and placed in a beaker, and 20 ml of methanol was poured therein and slightly mixed with the toner, and the calcium product is extracted from the toner surface by applying ultrasonic wave for 5 minutes. This extracting solution is naturally filtrated on a filter paper (5B). All the toner remaining in the beaker is also washed with methanol (30 ml), and the extracting solution is filtrated. The filtration residue is washed with methanol, (50 ml), and all of the calcium compound on the toner surface is extracted into the filtrate. The volume of the filtrate is adjusted to 100 ml with methanol, and a maximum fluorescence intensity of the filtrate is measured and from the above methanol analytical curve, an amount of the calcium product present on the toner surface of 1 g of the toner is calculated.

A calcium product present as a charge controlling agent on a surface of an electrostatic image developing toner of the present invention preferably has a volume base average particle size of from 0.05 $\mu$m to 3 $\mu$m.

A particle size of a calcium product present on a toner surface can be measured in the following manner. First, a predetermined amount of a toner is made into a thin film by heat-melting, and the thin film is enlarged about 500 times in an image by a polarizing microscope (BH-2, manufactured by Olympus Optical Co., Ltd.) equipped with an MLD camera in such a manner as to be able to recognize calcium compound particles only in the toner. The enlarged image thus obtained is transferred to an image analyzing apparatus (Luzex FS® manufactured by Nireko K.K.), to calculate a particle distribution of the calcium product particles by image analysis.

Also, in the same manner as above, a toner from which a calcium product only is extracted from a toner surface is made into a thin film by heat-melting, and its particle size distribution is measured. Judging from a difference between a particle size distribution of a calcium product present in the whole toner and a particle size distribution of a calcium product present only in the toner inside, a particle size distribution of a calcium product present on the toner surface is determined, and its average particle size is defined as average particle size of a calcium product present on the toner surface.

A solvent-dissolved remaining content of the toner of the present invention is preferably in a range of from 0 to 30 mass % as a content insoluble in tetrahydrofuran (THF), in a range of from 0 to 40 mass % as a content insoluble in ethyl acetate and in a range of from 0 to 30 mass % as a content insoluble in chloroform. The solvent-dissolved remaining content is measured by uniformly dissolving or dispersing 1 g of a toner respectively 100 ml of tetrahydrofuran (THF), ethyl acetate and chloroform, pressure-filtrating the solution or the dispersion, drying the filtrate to carry out quantitative determination, and calculating a percentage of an insoluble material of the toner, which is insoluble in an organic solvent.

Also, the charge controlling agent of the present invention is suitable also as a charge-enhancing agent for an electrostatic powder paint material. Thus, the electrostatic powder paint material using this charge-enhancing agent is excellent in environmental resistance, storage stability, particularly thermostability and durability, and a paint deposition efficiency reaches 100%, and a thick film having no painting defect can be formed.

EXAMPLES

Hereinafter, the present invention is further illustrated with reference to Examples and Comparative Examples, but should not be limited thereto. In the following Examples and Comparative Examples, the term "part" means "part by mass".

Preparation Example 1

21 Parts of 3,5-di-tert-butylsalicylic acid and 14 parts of 25% sodium hydroxide were added to 100 parts of water, and the resultant mixture was heated to 70° C., the pH of which was adjusted to around 7.5. After recognizing that 3,5-di-tert-butylsalicylic acid was completely dissolved, the solution temperature was lowered to 30° C., and the resultant sodium hydroxide solution containing 3,5-di-tert-butylsalicylic acid was dropwise added with fully stirring to a solution having 8 parts of calcium chloride dihydrate dissolved in 70 parts of water, the temperature of which was adjusted to 30° C. After finishing the dropwise adding, the solution temperature was maintained at 30° C. and the reaction was continued with stirring for 1 hour. A precipitated crystal was filtrated, washed with water and dried to obtain 2 parts of a white crystal. The product thus obtained had a melting point of at least 300° C.

According to elemental analysis of the product, it was proved that the product contained 62.6% of carbon and 8.0% of hydrogen. According to analysis by Karl Fischer method, it was proved that the product contained 6.27% of coordinated water.

The product was then subjected to IR measurement, the chart of which is shown in FIG. 1.

Figure 2:
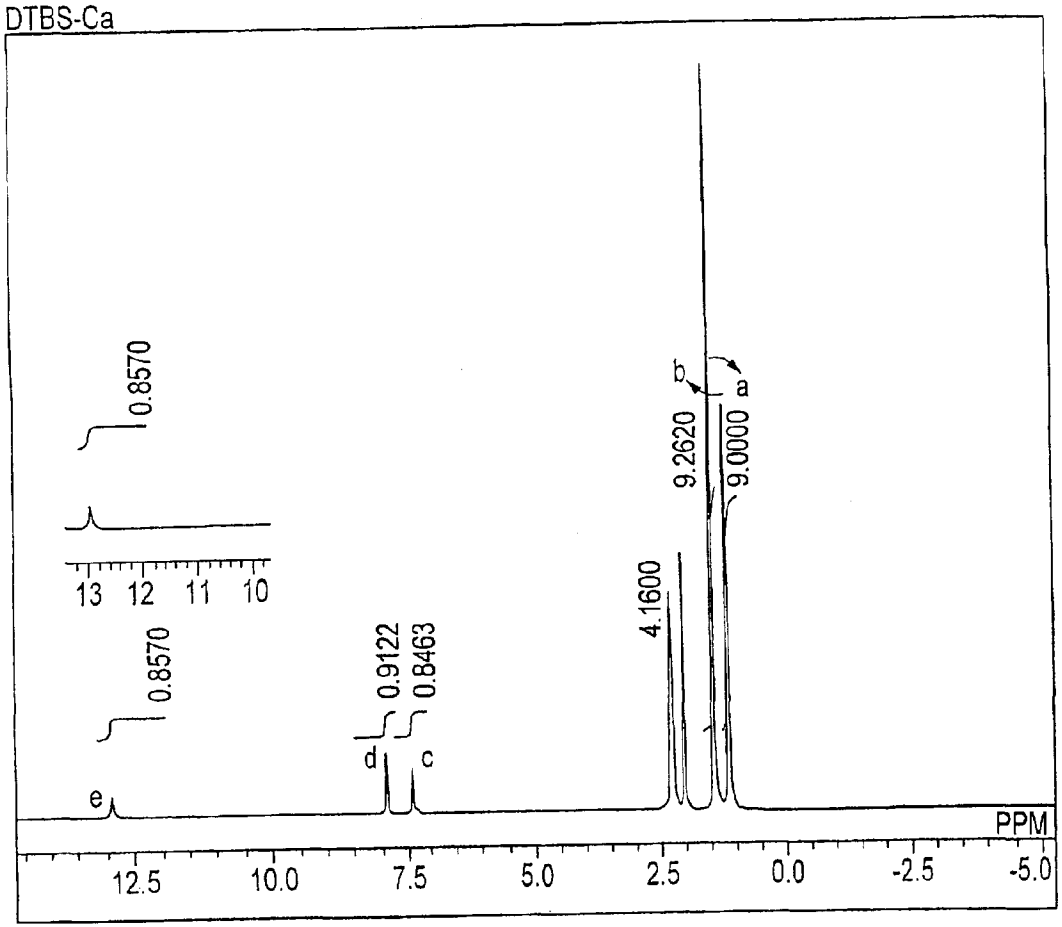
FIG. 2 is a proton NMR spectrum of the product obtained by Preparation Example 1.

The product was further subjected to proton NMR measurement, the spectrum of which is shown in FIG. 2. The measurement was carried out at a measurement temperature of 25.6° C. by using methanol (hydrogen of which is substituted with deuterium) as a solvent.

Figure 3:
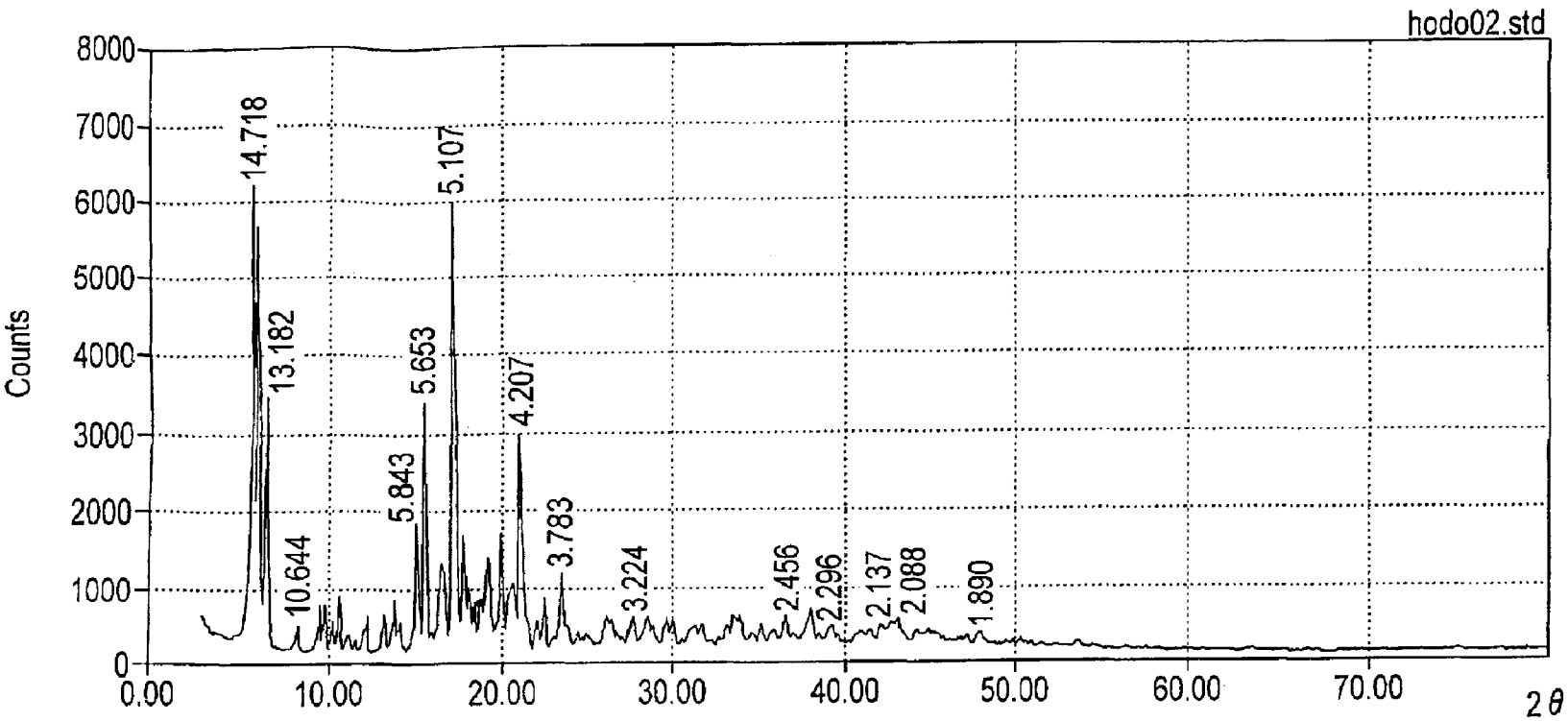
FIG. 3 is an X-ray diffraction chart of the product obtained by Preparation Example 1.

The product was still further subjected to X-ray diffraction analysis, the chart of which is shown in FIG. 3.

The obtained calcium product of white crystal was pulverized into about 5 $\mu$m in a pot mill, and a shape coefficient (SF-1) value was measured in the following manner.

Figure 4:
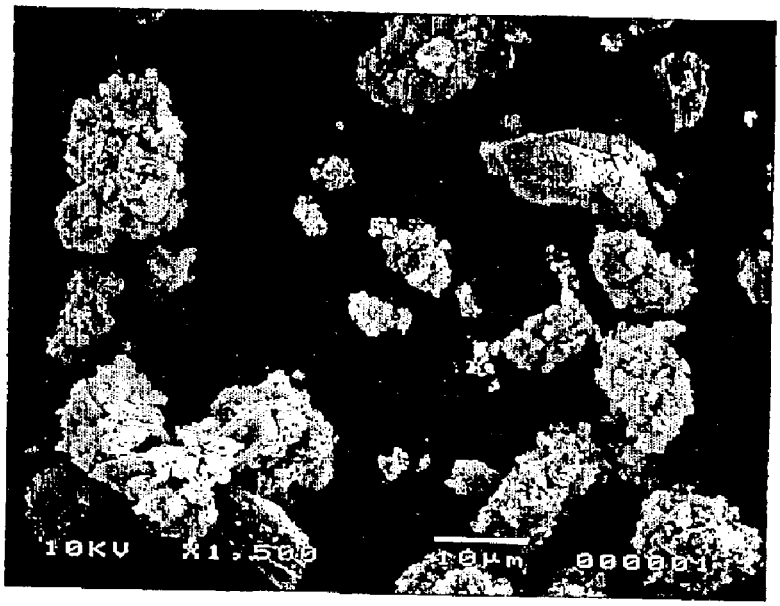
FIG. 4 is a scanning electromicroscope photograph of the product obtained by Preparation Example 1.
Figure 5:
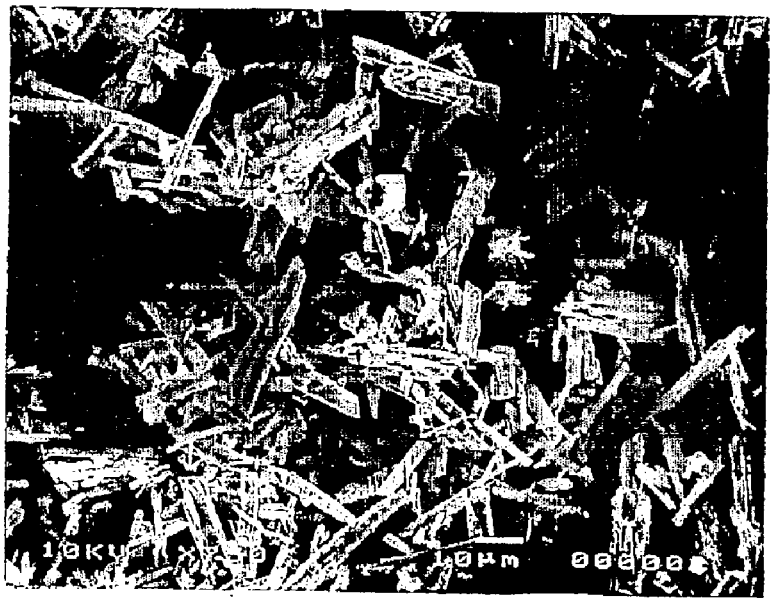
FIG. 5 is a scanning electromicroscope photograph of the product obtained by Comparative Preparation Example 2.

The pulverized white crystal of about 5 $\mu$m was uniformly placed on a slide glass. A magnification of an optical microscope was adjusted so as to observe about 30 particles in one view of the optical microscope, and shape coefficient (SF-1) values of about 3,000 particles were statistically calculated by using an image analyzing apparatus (Luzex FS® manufactured by Nireko K.K.). An average value of shape coefficient (SF-1) values of about 3,000 particles was 226, and an average value of shape coefficient (SF-2) values was 152. Its scanning type electron microscope photograph is shown in FIG. 4.

Preparation Example 2

21 Parts of 3,5-di-tert-butylsalicylic acid and 14 parts of 25% sodium hydroxide were added to 100 parts of water, and the resultant mixture was heated to 70° C., the pH of which was adjusted to around 7.5. After recognizing that 3,5-di-tert-butylsalicylic acid was completely dissolved, the solution temperature was lowered to 10° C., and the sodium hydroxide solution containing 3,5-di-tert-butylsalicylic acid was dropwise added with fully stirring to a solution having 8 parts of calcium chloride dihydrate dissolved in 70 parts of water, the temperature of which was adjusted to 10° C. After finishing the dropwise adding, the solution temperature was maintained at 10° C. and the reaction was continued with stirring for 1 hour. A precipitated crystal was filtrated, washed with water and dried to obtain 23 parts of a white crystal. According to the same calculation method carried out as in Preparation Example 1, a shape coefficient (SF-1) average value was 243, and a shape coefficient (SF-2) average value was 175.

Preparation Example 3

21 Parts of 3,5-di-tert-butylsalicylic acid and 14 parts of 25% sodium hydroxide were added to 100 parts of water, and the resultant mixture was heated to 70° C., the pH of which was adjusted to around 7.5. After recognizing that 3,5-di-tert-butylsalicylic acid was completely dissolved, the solution temperature was maintained at 70° C., and the sodium hydroxide solution containing 3,5-di-tert-butylsalicylic acid was dropwise added with fully stirring to a solution having 8 parts of calcium chloride dihydrate dissolved in 70 parts of water, the temperature of which was adjusted to 70° C. After finishing the dropwise adding, the solution temperature was maintained at 70° C. and the reaction was continued with stirring for 1 hour. A precipitated crystal was filtrated, washed with water and dried to obtain 22 parts of a white crystal. According to the same calculation method carried out as in Preparation Example 1, a shape coefficient (SF-1) average value was 249, and a shape coefficient (SF-2) average value was 190.

Comparative Preparation Example 1

21 Parts of 3,5-di-tert-butylsalicylic acid and 14 parts of 25% sodium hydroxide were added to 100 parts of water, and the solution was heated to 70° C., the pH of which was adjusted to around 7.5. After recognizing that 3,5-di-tert-butylsalicylic acid was completely dissolved, the solution temperature was heated to 80° C., and the sodium hydroxide solution containing 3,5-di-tert-butylsalicylic acid was dropwise added with fully stirring to a solution having 8 parts of calcium chloride dihydrate dissolved in 80 parts of water, the temperature of which was adjusted to 80° C. After finishing the dropwise adding, the reaction was continued with stirring at 80° C. for 1 hour. A precipitated crystal was filtrated, washed with water and dried to obtain 22 parts of a white crystal. According to the same calculation method carried out as in Preparation Example 1, a shape coefficient (SF-1) average value was 268, and a shape coefficient (SF-2) average value was 206.

Comparative Preparation Example 2

21 Parts of 3,5-di-tert-butylsalicylic acid and 14 parts of 25% sodium hydroxide were added to 100 parts of water, and the mixture was heated to 70° C., the pH of which was adjusted to around 7.5. After recognizing that 3,5-di-tert-butylsalicylic acid was completely dissolved, the solution was cooled to 30° C. A solution having 8 parts of calcium chloride dihydrate dissolved in 70 parts of water adjusted to 30° C. was dropwise added with stirring to the above-prepared sodium hydroxide solution containing 3,5-di-tert-butylsalicylic acid. The reaction was continued with stirring at 30° C. for 1 hour. A precipitated crystal was filtrated, washed with water and dried to obtain 22 parts of a white crystal. The white crystal thus obtained was pulverized into about 5 μm in the same manner as in Preparation Example 1, and was uniformly placed on a slide glass, and a magnification of an optical microscope was adjusted so as to observe about 30 particles in one view, and shape coefficients (SF-1) and (SF-2) of about 3,000 particles were statistically calculated by using an image analyzing apparatus. As these calculation results, a shape coefficient (SF-1) average value was 292, and a shape coefficient (SF-2) average value was 209. Its scanning type electron microscope photograph is shown in FIG. 7.

Comparative Preparation Example 3

20 Parts of 3,5-di-tert-butylsalicylic acid was added to 200 parts of 50% aqueous ethanol, and the mixture was heated to 60 to 65° C. to dissolve. 4 parts of calcium carbonate was gradually added thereto, and the mixture was stirred to 60 to 65° C. for 2 hours, and a precipitated crystal was filtrated, washed with water and dried to obtain 9 parts of a white crystal. According to the same calculation method carried out as in Preparation Example 1, a shape coefficient (SF-1) average value was 285, and a shape coefficient (SF-2) average value was 214.

Example 1

| | |
|---|---|
| Styrene-acrylic copolymer resin (acid value 0.1) (Tradename, CPR-100, manufactured by Mitsui Chemicals, Inc.) | 91 parts |
| Product obtained in Preparation Example 1 | 1 part |
| Carbon black (Tradename, MA-100, manufactured by Mitsubishi Chemical Corporation) | 5 parts |
| Low molecular weight polypropylene (tradename, Biscoal 550P, manufactured by Sanyo Kasei K.K.) | 3 parts |

The above mixture was melt-mixed at 140° C. in a heat-mixing apparatus, and the cooled mixture was roughly pulverized by a hammer mill. The mixture was further finely pulverized by a jet mill, and the pulverized product was classified to obtain a black toner having a volume average particle size of 9±0.5 μm. Two types of toners were prepared by mixing 4 parts of the above obtained toner with 100 parts of each of a non-coat type ferrite carrier (tradename, F-100, manufactured by Powder Tech K.K.) and a silicon coat type ferrite carrier (tradename, F96-100, manufactured by Powder Tech K.K.) and shaking the respective toners thus mixed to have the toners negatively charged, and the two types of toners thus obtained were measured by a blow-off powder charged amount-measuring apparatus. The results are shown in the following Table 1.

With regard to the above toners, respective methanol solutions having concentrations 2 ppm, 5 ppm, 10 ppm and 20 ppm of the calcium product as a charge controlling agent were prepared. These solutions were measured by a fluorescence spectrophotometer, and an analytical curve was made from a solution concentration and a maximum fluorescence intensity. Thereafter, 0.2 g of the toner of Example 1 containing the charge controlling agent was accurately weighed and placed in a beaker, and 20 ml of methanol was poured therein and slightly made familiar with the toner, and the calcium product was extracted from the toner surface by applying ultrasonic wave. This extracting solution was naturally filtrated on a filter paper (5B). All the toner remaining in the beaker was also washed with methanol (30 ml) and the extracting solution was filtrated. The filtration residue was washed with methanol (50 ml), and all of the charge controlling agent on the toner surface was extracted into the filtrate. The volume of the filtrate was adjusted to 100 ml with methanol, and a maximum fluorescence intensity of the filtrate was measured and from the above methanol analytical curve, an amount of the calcium product present on the toner surface of 1 g of the toner was calculated. Thus, an amount of the charge controlling agent present on the toner surface (amount present on the toner surface) was 2.92 (mg/1 g toner).

Examples 2 to 3

In the same manner as in Example 1, except that "product obtained in Preparation Example 1" was replaced respectively by "product obtained in Preparation Example 2" and "product obtained in Preparation Example 3", toners of Examples 2 and 3 were prepared by employing the same amounts, and were measured by a blow-off powder charged amount-measuring apparatus. The results are shown in the following Table 1. An amount of a charge controlling agent present on the toner surface of Example 2 was 2.64 (mg/1 g toner), and an amount of a charge controlling agent present on the toner surface of Example 3 was 2.54 (mg/1 g toner).

Comparative Example 1

| | |
|---|---|
| Styrene-acrylic copolymer resin (acid value 0.1) (Tradename, CPR-100, manufactured by Mitsui Chemicals, Inc.) | 91 parts |
| Product obtained in Comparative Preparation Example 1 | 1 part |
| Carbon black (Tradename, MA-100, manufactured by Mitsubishi Chemical Corporation) | 5 parts |
| Low molecular weight polypropylene (tradename, Biscoal 550P, manufactured by Sanyo Kasei K.K.) | 3 parts |

The above mixture was melt-mixed at 140° C. in a heat-mixing apparatus, and the cooled mixture was roughly pulverized by a hammer mill. The mixture was further finely pulverized by a jet mill, and the pulverized product was classified to obtain a black toner having a volume average particle size of 9±0.5 μm Two types of toners were prepared by mixing 4 parts of the above prepared toner with 100 parts of each of a non-coat type ferrite carrier (tradename, F-100, manufactured by Powder Tech K.K.) and a silicon coat type ferrite carrier (tradename, F96-100, manufactured by Powder Tech K.K.) and shaking the respective toners thus mixed to have the toners negatively charged, and the two types of toners were measured by a blow-off powder charged amount-measuring apparatus. The results are shown in the following Table 1.

An amount of the charge controlling agent present on the toner surface was 1.92 (mg/1 g toner).

Comparative Examples 2 to 3

In the same manner as in Comparative Example 1, except that "product obtained in Comparative Preparation Example 1" was replaced respectively by "product obtained in Comparative Preparation Example 2" and "product obtained in Comparative Preparation Example 3", toners of Comparative Example 2 and Comparative Example 3 were prepared by employing the same amounts, and were measured by a blow-off powder charged amount-measuring apparatus. The results are shown in the following Table 1. An amount of the charge controlling agent present on the toner surface of Comparative Example 2 was 1.99 (mg/1 g toner), and an amount of the charge controlling agent present on the toner surface of Comparative Example 3 was 1.99 (mg/1 g toner).

TABLE 1

| | Charged amount (μc/g) | |
|---|---|---|
| | Non-coat ferrite carrier | Silicon coat ferrite carrier |
| Ex. 1 | −26.9 | −12.3 |
| Ex. 2 | −25.8 | −11.8 |
| Ex. 3 | −20.9 | −9.9 |
| Comp. Ex. 1 | −15.5 | −5.8 |
| Comp. Ex. 2 | −17.0 | −6.4 |
| Comp. Ex. 3 | −16.4 | −7.7 |

Example 4

| | |
|---|---|
| Styrene-acrylic copolymer resin (acid value 0.1) (Tradename, CPR-100, manufactured by Mitsui Chemicals, Inc.) | 100 parts |
| Product obtained in Preparation Example 1 | 2 parts |
| Magnetic iron oxide | 90 parts |
| Low molecular weight polypropylene (tradename, Biscoal 550P, manufactured by Sanyo Kasei K.K.) | 3 parts |

The above mixture was melt-mixed at 140° C. in a heat-mixing apparatus, and the cooled mixture was roughly pulverized by a hammer mill. The pulverized product was further finely pulverized by a jet mill, and was classified to obtain a black toner having a volume average particle size of 9±0.5 μm. Two types of toners were prepared by mixing 4 parts of the above prepared toner with 100 parts of each of a non-coat type ferrite carrier (tradename, F-100, manufactured by Powder Tech K.K.) and a silicon coat type ferrite carrier (tradename, F96-100, manufactured by Powder Tech K.K.) and shaking the respective mixtures to have the toners negatively charged, and were measured by a blow-off powder charged amount-measuring apparatus. The results are shown in the following Table 2.

Examples 5 to 6

In the same manner as in Example 4, except that "product obtained in Preparation Example 1" was replaced respectively by "product obtained in Preparation Example 2" and "product obtained in Preparation Example 3", toners of Examples 5 and 6 were prepared by employing the same amounts as in Example 4, and were measured by a blow-off powder charged amount-measuring apparatus. The results are shown in the following Table 2.

Comparative Example 4

| | |
|---|---|
| Styrene-acrylic copolymer resin (acid value 0.1) (Tradename, CPR-100, manufactured by Mitsui Chemicals, Inc.) | 100 parts |
| Product obtained in Comparative Preparation Example 1 | 2 parts |
| Magnetic iron oxide | 90 parts |
| Low molecular weight polypropylene (tradename, Biscoal 550P, manufactured by Sanyo Kasei K.K.) | 3 parts |

The above mixture was melt-mixed at 140° C. in a heat-mixing apparatus, and the cooled mixture was roughly pulverized by a hammer mill. The roughly pulverized product was further finely pulverized by a jet mill, and was classified to obtain a black toner having a volume average particle size of 9±0.5 μm. Two types of toners were prepared by mixing 4 parts of the above prepared toner with 100 parts of each of a non-coat type ferrite carrier (tradename, F-100, manufactured by Powder Tech K.K.) and a silicon coat type ferrite carrier (tradename, F96-100, manufactured by Powder Tech K.K.) and shaking the respective mixtures to have the toners negatively charged, and the toners thus prepared were measured by a blow-off powder charged amount-measuring apparatus. The results are shown in the following Table 2.

Comparative Examples 5 to 6

In the same manner as in Comparative Example 4, except that "product obtained in Comparative Preparation Example 1" was replaced respectively by "product obtained in Comparative Preparation Example 2" and "product obtained in Comparative Preparation Example 3", toners of Comparative Example 5 and Comparative Example 6 were prepared by employing the same amounts as in Comparative Example 4, and the toners thus prepared were measured by a blow-off powder charged amount-measuring apparatus. The results are shown in the following Table 2.

TABLE 2

| | Charged amount (μc/g) | |
|---|---|---|
| | Non−coat ferrite carrier | Silicon coat ferrite carrier |
| Ex. 4 | −21.6 | −10.9 |
| Ex. 5 | −20.1 | −10.1 |
| Ex. 6 | −17.1 | −9.6 |
| Comp. Ex. 4 | −12.1 | −5.8 |
| Comp. Ex. 5 | −13.4 | −6.9 |
| Comp. Ex. 6 | −12.3 | −6.0 |

(Evaluation of Image Properties in Accordance with Non-Magnetic Two-Component Developing Method)

A developer was prepared by mixing 4 parts of a toner of each of Examples 1 to 3 and Comparative Examples 1 to 3 with 100 parts of a silicon coat type ferrite carrier (tradename, F96-100, manufactured by Powder Tech K.K.), and image properties of the toners thus prepared were evaluated in accordance with non-magnetic two-component developing system. An image-forming apparatus used in the evaluation of the image properties was a commercially available copying machine of non-magnetic two-component developing system, which was remodeled so as to be able to optionally control a surface potential of a photosensitive material, the voltage applied to a developing roller, the voltage of transferring and a fixing temperature, and each condition was determined so as to make the best printing at the initial image. The evaluation of image properties was carried out by printing with a toner continuously supplied and sampling a 10th printed sheet (initial image), a 5,000th sheet after continuous printing and a 20,000th printed sheet after initiating test chart printing.

An image intensity was measured by using a plain paper (75 g/m$^2$), sampling a printed sheet after printing a predetermined number of sheets, and measuring a density of a black solid printed part of the sampled printed sheet by a Macbeth reflection densitometer (RD-918, manufactured by Sakata Inks K.K.). A fog density was determined by measuring a reflection density of a non-printed part and deducting a reflection density (0.05) of the plain paper before printing as a base value from the above measured reflection density value. A fine line reproducibility was evaluated as to whether fine lines of 30 μm on a test chart could be faithfully reproduced or not. A memory occurrence was evaluated by visually observing. The results are shown in the following Table 3. In the following Table 3, a fine line reproducibility was expressed by ○ when fine lines were faithfully reproduced and expressed by X when fine lines were not faithfully reproduced.

TABLE 3

| | Evaluation of image properties | | | |
|---|---|---|---|---|
| | Image density | Fog density | Fine line reproducibility | Memory occurrence |
| Example 1 | | | | |
| (Initial image) | 1.43 | 0.00 | ○ | Absence |
| (5,000th sheet) | 1.45 | 0.02 | ○ | Absence |
| (20,000th sheet) | 1.44 | 0.02 | ○ | Absence |
| Example 2 | | | | |
| (Initial image) | 1.45 | 0.01 | ○ | Absence |
| (5,000th sheet) | 1.43 | 0.02 | ○ | Absence |
| (20,000th sheet) | 1.44 | 0.01 | ○ | Absence |
| Example 3 | | | | |
| (Initial image) | 1.42 | 0.00 | ○ | Absence |
| (5,000th sheet) | 1.44 | 0.02 | ○ | Absence |
| (20,000th sheet) | 1.43 | 0.01 | ○ | Absence |
| Comparative Example 1 | | | | |
| (Initial image) | 1.45 | 0.03 | ○ | Absence |
| (5,000th sheet) | 1.43 | 0.09 | X | Absence |
| (20,000th sheet) | 1.32 | 0.10 | X | Absence |
| Comparative Example 2 | | | | |
| (Initial image) | 1.43 | 0.02 | ○ | Absence |
| (5,000th sheet) | 1.41 | 0.05 | ○ | Absence |
| (20,000th sheet) | 1.40 | 0.07 | X | Absence |
| Comparative Example 3 | | | | |
| (Initial image) | 1.35 | 0.05 | ○ | Absence |
| (5,000th sheet) | 1.32 | 0.08 | X | Absence |
| (20,000th sheet) | 1.29 | 0.13 | X | Presence |

Examples 1 to 3 provided an image density in a range of from 1.40 to 1.45 which is considered to be desirable in this copying machine. Also, the image density was not substantially changed and was stable during long term continuous printing. Further, a fog density value was quite low, and did not increase during continuous printing. Also, a fine line reproducibility was good and stable. Still further, there was no memory occurrence indicating image degradation by repetition.

Comparative Examples 1 and 2 provided a satisfactory image at the initial stage, but an image density was somewhat lowered and a fog density was raised after continuously printing 5,000 sheets. These image degradations became further severe and remarkable after continuously printing 20,000 sheets, and reached a troublesome level. Also, a fine line reproducibility was severely degraded by long term continuous printing.

Comparative Example 3 could not provide a satisfactory image from the initial stage, and the degradation was further accelerated by continuous printing. Also, a fine line reproducibility was degraded after 20,000 sheets, and a memory occurrence due to lack of cleaning was recognized.

(Evaluation of Image Properties in Accordance with Magnetic One-Component Developing System)

Image properties of toners prepared in Examples 4 to 6 and Comparative Examples 4 to 6 were evaluated in accordance with magnetic one-component developing system.

An image-forming apparatus used to carry out the evaluation of image properties was a commercially available printer of magnetic one-component developing system (resolving power 600 dpi) which was remodeled so as to be able to control a surface potential of a photosensitive material, a voltage applied to a developing roller, a voltage of transferring and a fixing temperature, and each condition was determined so as to make the best printing at the initial image.

Printing was carried out by continuously supplying a toner and forwarding a test chart from a personal computer. The evaluation of image properties was carried out by sampling a 10th printed sheet (initial image) from the initiation of printing, a 1,000th continuously printed sheet and a 5,000th continuously printed sheet.

An image density was measured by sampling an image on a plain paper (75 g/m$^2$) after printing a predetermined number of sheets, and measuring a density of a black solid printed part by a Macbeth reflection densitometer (RD-918, manufactured by Sakata Inks K.K.) Also, a fog density was determined by measuring a reflection density of a non-printed part and deducting a reflection density (0.05) of the plain paper before printing as a base value from the above measured density. A dot reproducibility was evaluated by judging as to whether dots of a test chart were faithfully reproduced or not, and the dot reproducibility was judged as to whether an independent dot pattern of about 50 μm could be reproduced without defect or not. Among about 50 dots, if an amount of defective dots was at least 10%, the dot reproducibility was considered to be no good, whereas if an amount of defective dots was less than 10%, the reproducibility was considered to be good. A memory occurrence was evaluated by judging its presence or absence by visual observation. The results are shown in the following Table 4.

TABLE 4

| | Evaluation of image properties | | | |
|---|---|---|---|---|
| | Image density | Fog density | Dot reproducibility | Memory occurrence |
| Example 4 | | | | |
| (Initial image) | 1.53 | 0.00 | Good | Absence |
| (1,000th sheet) | 1.52 | 0.01 | Good | Absence |
| (5,000th sheet) | 1.52 | 0.02 | Good | Absence |
| Example 5 | | | | |
| (Initial image) | 1.54 | 0.01 | Good | Absence |
| (1,000th sheet) | 1.53 | 0.03 | Good | Absence |
| (5,000th sheet) | 1.55 | 0.02 | Good | Absence |
| Example 6 | | | | |
| (Initial image) | 1.51 | 0.01 | Good | Absence |
| (1,000th sheet.) | 1.54 | 0.00 | Good | Absence |
| (5,000th sheet) | 1.52 | 0.03 | Good | Absence |
| Comparative Example 4 | | | | |
| (Initial image) | 1.48 | 0.02 | Good | Absence |
| (1,000th sheet) | 1.43 | 0.06 | Good | Absence |
| (5,000th sheet) | 1.35 | 0.13 | No good | Absence |
| Comparative Example 5 | | | | |
| (Initial image) | 1.52 | 0.02 | Good | Absence |
| (1,000th sheet) | 1.43 | 0.08 | Good | Absence |
| (5,000th sheet) | 1.42 | 0.07 | No good | Absence |

TABLE 4-continued

| | Evaluation of image properties | | | |
|---|---|---|---|---|
| | Image density | Fog density | Dot reproducibility | Memory occurrence |
| Comparative Example 6 | | | | |
| (Initial image) | 1.53 | 0.01 | Good | Absence |
| (1,000th sheet) | 1.32 | 0.15 | No good | Absence |
| (5,000th sheet) | 1.19 | 0.13 | No good | Presence |

In Examples 4 to 6, an image density was good and was in a range of from 1.45 to 1.55 which is considered to be desirable for a printer. The density was not substantially changed and was stable during long term continuous printing. A fog density value was also quite low, and did not increase during continuous printing. A dot reproducibility was also good and was stable. A memory occurrence indicating image degradation by repetition was not observed at all.

In Comparative Examples 4 and 5, a satisfactory image could be obtained at the initial stage, but an image density was lowered and a fog density was raised when 1,000 sheets were continuously printed. Further, these image degradations became remarkable and reached a troublesome level after continuously printing 5,000 sheets. A dot reproducibility was greatly degraded by long term continuous printing.

In Comparative Example 6, a satisfactory image could be obtained at the initial image, but a degradation was rapidly accelerated during continuous printing. After printing 5,000 sheets, a dot reproducibility was degraded and a memory occurrence due to lack of cleaning was recognized.

INDUSTRIAL APPLICABILITY

The charge controlling agent of the present invention does not contain a heavy metal such as chromium, and has a pale white color suitable to be used for a color toner, and provides a high charge-imparting effect. Also, the toner of the present invention containing this charge controlling agent provides excellent images highly evaluated in respect of image properties such as an image density, a fog density and the like in any of one-component or two-component developing system.

What is claimed is:

1. A charge controlling agent comprising a reaction product of an aromatic hydroxycarboxylic acid and a calcium compound bonded by at least one bonding system selected from the group consisting of coordinate bonding, covalent bonding and ionic bonding, wherein the charge controlling agent has a shape coefficient (SF-1) average value of at most 250 calculated in accordance with the following formula, $$SF\text{-}1=\{(ML^2\times\pi)/4A\}\times 100$$

wherein ML is a maximum length of a particle and A is a projected area of one particle.

2. The charge controlling agent according to claim 1, wherein the charge controlling agent has a shape coefficient (SF-2) average value of at most 200 calculated in accordance with the following formula, $$SF\text{-}2=(PM^2/4A\pi)\times 100$$

wherein PM is a circumference length of a particle and A is a projected area of one particle.

3. The charge controlling agent according to claim 1, wherein the aromatic hydroxycarboxylic acid is 3,5-di-tert-butylsalicylic acid.

4. A method for producing a charge controlling agent comprising a reaction product of an aromatic hydroxycarboxylic acid and a calcium compound bonded by at least one bonding system selected from the group consisting of coordinate bonding, covalent bonding and ionic bonding, said method comprising reacting the aromatic hydroxycarboxylic acid and the calcium compound by dropwise addition of a solution of the aromatic hydroycarboxylic acid to solution of th calcium compound as a metal-imparting agent to produce a charge controlling agent wherein the charge controlling agent has a shape coefficient (SF-1) average value of at most 250 calculated in accordance with the following formula, $$SF\text{-}1=\{(ML^2\times\pi)/4A\}\times 100$$

wherein ML is a maximum length of a particle and A is a projected area of one particle.

5. The method for producing a charge controlling agent according to claim 4, wherein the reaction product has a shape coefficient (SF-2) average value of at most 200 calculated in accordance with the following formula, $$SF\text{-}2=(PM^2/4A\pi)\times 100$$

wherein PM is a circumference length of a particle and A is a projected area of one particle.

6. The method for producing a charge controlling agent according to claim 4, wherein an aromatic hydroxycarboxylic acid and a calcium compound are reacted at a temperature of from 10 to 70° C. by dropwise addition of a solution of the aromatic hydroxycarboxylic acid to a solution of the calcium compound as the metal-imparting agent.

7. The method for producing a charge controlling agent according to claim 4, wherein the aromatic hydroxycarboxylic acid is 3,5-di-tert-butylsalicylic acid.

8. An electrostatic image developing toner which comprising a binding resin, a coloring agent and at least one charge controlling agent selected from a charge controlling agent as defined in claim 1.

9. The electrostatic image developing toner according to claim 8, which comprises the charge controlling agent, a binder resin, a coloring agent, and further a wax and/or a magnetic material.

10. The electrostatic image developing toner according to claim 8, wherein the charge controlling agent has a presence ratio on a toner surface of at least 2.0 mg/l of toner.

11. A one-component developing method, comprising developing an electrostatic image with an electrostatic image developing toner as defined in claim 8.

12. A two-component developing method, comprising developing an electrostatic image with an electrostatic image developing toner as defined in claim 8 and a carrier.

* * * * *